US009481543B2

(12) United States Patent
Yoneta

(10) Patent No.: US 9,481,543 B2
(45) Date of Patent: Nov. 1, 2016

(54) VARIABLE CUTOFF FOLDING DEVICE AND PRINTER COMPRISING VARIABLE CUTOFF FOLDING DEVICE

(71) Applicant: Kabushiki Kaisha Tokyo Kikai Seisakusho, Tokyo (JP)

(72) Inventor: Mutsuhito Yoneta, Chiba (JP)

(73) Assignee: KABUSHIKI KAISHA TOKYO KIKAI SEISAKUSHO (JP)

( * ) Notice: Subject to any disclaimer, the term of this patent is extended or adjusted under 35 U.S.C. 154(b) by 664 days.

(21) Appl. No.: 13/887,906

(22) Filed: May 6, 2013

(65) Prior Publication Data

US 2014/0141955 A1 May 22, 2014

(30) Foreign Application Priority Data

Nov. 21, 2012 (JP) ..... 2012-255597

(51) Int. Cl.
*B65H 45/06* (2006.01)
*B65H 45/16* (2006.01)
*B65H 45/28* (2006.01)

(52) U.S. Cl.
CPC ..... *B65H 45/06* (2013.01); *B65H 45/165* (2013.01); *B65H 45/168* (2013.01); *B65H 45/28* (2013.01)

(58) Field of Classification Search
CPC .. B65H 37/06; B65H 45/163; B65H 45/165; B65H 45/168; B65H 45/06; B65H 45/28; B65H 45/00; B65H 45/16
USPC ..... 493/428, 432, 445, 446, 437, 444; 1/428, 432, 445, 446, 437, 444
See application file for complete search history.

(56) References Cited

U.S. PATENT DOCUMENTS 1,754,038 A * 4/1930 Orndoff ..... B65H 45/16 493/432
1,900,288 A * 3/1933 Jordhoy ..... B65H 45/161 270/50
2,016,486 A * 10/1935 Crafts ..... B65H 45/168 270/13
2,022,688 A * 12/1935 Quick ..... B41F 13/54 270/44
2,335,431 A * 11/1943 Meyer ..... B41F 13/54 270/43
2,435,881 A * 2/1948 Facber ..... B65H 45/163 271/82
2,814,484 A * 11/1957 Stobb ..... B65H 45/166 270/43

(Continued)

FOREIGN PATENT DOCUMENTS

CN 1839082 A 9/2006
CN 101096251 A 1/2008

(Continued)

*Primary Examiner* — Robert Long
*Assistant Examiner* — Lucas Palmer
(74) *Attorney, Agent, or Firm* — James R. Foley; Clark Hill PLC

(57) ABSTRACT

A variable cutoff folding device 1 comprising a folding cylinder 40 and a jaw cylinder 50, the folding cylinder 40 comprising: a paper edge holding mechanism 41 configured capable of holding a front edge portion in a conveying direction of an individual sheet FP and capable of changing a timing for releasing holding of the individual sheet FP based on a length in the conveying direction of the individual sheet FP; and a thrust blade mechanism 43 configured capable of thrusting the individual sheet FP to an outer side in a radial direction of the folding cylinder and capable of changing a position in a circumferential direction in the folding cylinder 40 based on the length in the conveying direction of the individual sheet FP.

5 Claims, 13 Drawing Sheets

(56) References Cited

U.S. PATENT DOCUMENTS 3,059,921 A * 10/1962 Ayre ..... B65H 45/168 493/353
3,459,421 A * 8/1969 Motter ..... B65H 29/40 271/279
3,865,361 A * 2/1975 Neal ..... B65H 45/168 101/411
4,190,242 A * 2/1980 Bolza-Schunemann B65H 45/161 270/42
5,096,174 A * 3/1992 Nishihara ..... B65H 45/168 270/21.1
5,287,805 A * 2/1994 Fischer ..... B65H 45/168 101/219
6,010,122 A * 1/2000 Weber ..... B65H 35/02 270/32
6,165,118 A * 12/2000 Eckert ..... B65H 45/168 493/425
6,709,376 B2 * 3/2004 Nanba ..... B65H 45/163 493/424
7,390,292 B2 * 6/2008 Held ..... B65H 45/167 493/428
7,494,455 B2 * 2/2009 Held ..... B65H 45/168 493/424
2003/0096688 A1 * 5/2003 Lange ..... B65H 45/163 493/405
2003/0126966 A1 * 7/2003 Hartmann ..... B65H 35/08 83/338
2003/0130103 A1 * 7/2003 Fujinuma ..... B65H 45/163 493/432
2003/0232710 A1 * 12/2003 Tokiwa ..... B65H 45/163 493/428
2004/0063559 A1 * 4/2004 Ochsenbauer ..... B31F 1/0019 493/427
2004/0075208 A1 * 4/2004 Takahashi ..... B65H 29/40 270/32
2005/0029729 A1 * 2/2005 Sappal ..... B65H 45/163 270/5.01
2005/0245379 A1 * 11/2005 Ishikawa ..... B65H 26/02 493/432
2005/0277537 A1 * 12/2005 Matsushita ..... B65H 37/06 493/444
2007/0135286 A1 * 6/2007 St. Ours ..... B65H 45/16 493/424
2007/0170646 A1 * 7/2007 Pangle ..... B65H 5/307 271/277
2008/0064583 A1 * 3/2008 Belleculee ..... B65H 45/168 493/429
2008/0288112 A1 * 11/2008 Hoehle ..... B65H 45/168 700/275
2009/0203510 A1 * 8/2009 Kurihara ..... B65H 45/162 493/434
2009/0239727 A1 * 9/2009 Wingate ..... B26D 1/405 493/356
2011/0187802 A1 * 8/2011 Fujio ..... B41F 13/62 347/104
2012/0122647 A1 * 5/2012 Sezaki ..... B41J 11/66 493/324
2012/0165173 A1 * 6/2012 Maeda ..... B65H 45/168 493/356
2015/0307309 A1 * 10/2015 Aizawa ..... B65H 29/52 270/52.09

FOREIGN PATENT DOCUMENTS

CN 102556754 A 7/2012
DE GB 1214339 A * 12/1970 ..... B65H 45/163
DE 4241810 A1 * 6/1994 ..... B41F 13/54
DE EP 0531648 B1 * 3/1995 ..... B65H 45/168
DE GB 2288167 A * 10/1995 ..... B65H 45/163
DE 4426987 A1 * 2/1996 ..... B65H 45/165
DE EP 0931748 A1 * 7/1999 ..... B65H 45/165
DE EP 1074500 A1 * 1/2001 ..... B65H 45/168
DE CA 2389839 A1 * 12/2002 ..... B65H 45/168
DE WO 2005102891 A1 * 11/2005 ..... B65H 45/168
DE WO 2008031690 A1 * 3/2008 ..... B41F 13/62
DE 102010001171 A1 7/2011
EP 1 069 063 1/2001
EP 1 693 327 8/2006
GB 915210 A * 1/1963 ..... B65H 45/168
JP 58-051149 3/1983
JP 10-250930 A 9/1998
JP 2001-026374 1/2001
JP EP 1069063 A2 * 1/2001 ..... B65H 45/168
JP 2003-146535 5/2003
JP EP 1318096 A2 * 6/2003 ..... B65H 45/28
JP EP 1475336 A1 * 11/2004 ..... B65H 45/168
JP 2006-044919 2/2006
JP EP 1693327 A1 * 8/2006 ..... B65H 45/28
JP 2008-007294 1/2008
JP 4191732 9/2008
JP EP 2174901 A1 * 4/2010 ..... B65H 45/168
JP 2011-157168 8/2011
JP 2012-101918 5/2012
JP 2012101918 A * 5/2012
JP 2012-144370 8/2012
JP 2012144370 A * 8/2012
WO 2005/102889 A1 11/2005

* cited by examiner

VARIABLE CUTOFF FOLDING DEVICE AND PRINTER COMPRISING VARIABLE CUTOFF FOLDING DEVICE

CROSS REFERENCE TO RELATED APPLICATIONS

This application is based upon and claims the benefit of priority from prior Japanese Patent Application No. 2012-255597, filed on Nov. 21, 2012, the entire contents of which are incorporated herein by reference.

BACKGROUND OF THE INVENTION

1. Field of the Invention

The present invention relates to a variable cutoff folding device capable of handling a change in cutoff (cutting length) of a continuous paper, and a printer comprising the variable cutoff folding device.

2. Description of the Related Art

In a conventional rotary press, in order to change cutoff in a direction of continuity of a continuous paper, it is necessary to exchange the likes of a printing plate or a plate cylinder on which the printing plate is mounted, so that realistically cutoff could not be easily changed.

To counter this, a digital printer disclosed in Patent Document 1 identified below has become publicly known. The digital printer disclosed in Patent Document 1 differs from a rotary press in not requiring a printing plate. It is therefore possible to easily carry out a change in cutoff in a direction of continuity of the continuous paper.

In addition, a folding device disclosed in Patent Document 2 identified below has become publicly known. The folding device disclosed in Patent Document 2 is capable of collect folding that allows overlapping of sheets on an outer circumferential surface of a folding cylinder to be performed to an amount of a desired number.

The folding device disclosed in Patent Document 2 is a folding device that protrudes a pin of a pin device installed in the folding cylinder from the outer circumferential surface of the folding cylinder, stabs the pin into a leading edge in a running direction of a cut sheet (cut sheets), wraps the sheet(s) on the outer circumferential surface of the folding cylinder while holding the sheet(s), operates a thrust blade device installed in the folding cylinder, at a position of minimum distance between the folding cylinder and a jaw cylinder, based on a predetermined operating signal, and, simultaneously to causing a middle portion of the sheet(s) to be gripped by a jaw device installed in the jaw cylinder, retracts the pin of the pin device to release the held sheet(s), thereby producing a signature.

However, in the folding device disclosed in Patent Document 2, there was a problem that circumferential length of the folding cylinder does not change, hence when cutoff of the continuous paper is changed, a cycle of the folding cylinder making a single rotation and a sheet spacing of continuously supplied cut individual sheets are not synchronous, whereby it becomes impossible to continuously wrap the individual sheets at an accurate wrapping position.

Accordingly, there appears a folding device, of the kind disclosed in Patent Document 3 identified below, that, accompanying a change in cutoff, adjusts timing when wrapping the cut sheets on the folding cylinder. (Hereinafter, this folding device is referred to as a "variable cutoff folding device".) The conventional variable cutoff folding device disclosed in Patent Document 3 comprises a printing device, a cutting device and a processing device, and, furthermore, comprises a first conveyor belt device and a second conveyor belt device between the cutting device and the processing device. The conventional variable cutoff folding device including these devices is configured to cut the web supplied from the printing device after changing the cutting length of said web and set a conveying speed of said web to a speed that accords with the cutting length of the sheets cut by the cutting device, and at the same time to set a sheet conveying speed in the first conveyor belt device to have an equal speed to that of the web conveying speed. Furthermore, the conventional variable cutoff folding device is configured to, when receiving said sheets from the first conveyor belt device by means of the second conveyor belt device, receive the sheets with the same speed as the sheet conveying speed in the first conveyor belt device, then change the sheet conveying speed during conveyance of the sheets and, when transferring the sheets to the processing device, transfer the sheets with the same speed as the sheet conveying speed in the processing device.

[Patent Document 1] JP 2011-157168 A
[Patent Document 2] JP 2012-144370 A
[Patent Document 3] JP 4191732 B2

SUMMARY OF THE INVENTION

However, there was a problem that although the variable cutoff folding device disclosed in Patent Document 3 identified above makes it possible to continuously wrap the cut individual sheets on the folding cylinder at an accurate wrapping position accompanying a change in cutoff, timing of retracting the pin of the pin device in the folding cylinder to withdraw the pin from the held sheets when the sheets wrapped on the folding cylinder are caused to be gripped by the jaw device of the jaw cylinder cannot be changed.

For example, if the pin gets withdrawn from the sheets wrapped on the folding cylinder at an earlier timing than when the sheets are gripped by the jaw device, the sheets get misaligned from the folding cylinder, the thrust blade enters the sheets at a place which is not the middle portion of cutoff of the sheets in the jaw device, and a deviation in a folding line of the signature (top and bottom are misaligned or folded diagonally) occurs, thereby causing deterioration in quality of the signature produced. Moreover, if the pin is still holding the sheets when the sheets are gripped by the jaw device, that is, if timing of withdrawing the pin from the sheets is late, the sheets are pulled by the pin device, the sheets disengage from the jaw device, the disengaged sheets wind around the cylinders or rollers in the folding device, and a paper jam occurs, causing problems such as delay in processes due to machine stoppage, or damage of machinery, and so on.

The present invention was made in view of the above problems of the conventional technology, and an object of the present invention is to provide a variable cutoff folding device that, accompanying a change in cutoff, allows a pin to be withdrawn from sheets at a suitable timing based on that cutoff, and a printer comprising this variable cutoff folding device.

A variable cutoff folding device according to the present invention comprises: a folding cylinder for sequentially receiving an individual sheet conveyed from an upstream side; and a jaw cylinder for receiving the individual sheet from said folding cylinder and carrying the individual sheet to a downstream side, the folding cylinder comprising: a paper edge holding mechanism configured capable of holding a front edge portion in a conveying direction of the individual sheet and capable of changing a timing for releasing holding of the individual sheet based on a length in the conveying direction of the individual sheet; and a thrust blade mechanism configured capable of thrusting the individual sheet to an outer side in a radial direction of the folding cylinder and capable of changing a position in a circumferential direction in the folding cylinder based on the length in the conveying direction of the individual sheet.

The variable cutoff folding device according to the present invention may be configured such that the paper edge holding mechanism comprises: a drive cam that includes an endless cam surface on a circumferential surface thereof and is capable of angular displacement around an axial center of the folding cylinder, the endless cam surface being configured from a holding region and a releasing region, the holding region having a certain radius, and the releasing region having a radius which is smaller than that of said holding region; a drive cam drive means for causing the drive cam to undergo angular displacement around the axial center of the folding cylinder; a drive cam-dedicated cam follower provided to be movable along the endless cam surface of the drive cam; and a paper holding pin that is connected to the drive cam-dedicated cam follower, is configured such that, when said drive cam-dedicated cam follower moves along the holding region of said endless cam surface, a tip of the paper holding pin projects further to the outer side in the radial direction of the folding cylinder than the circumferential surface of the folding cylinder, and is configured such that, when said drive cam-dedicated cam follower moves along the releasing region of said endless cam surface, said tip of the paper holding pin retracts further to an inner side in the radial direction of the folding cylinder than the circumferential surface of the folding cylinder.

Moreover, the variable cutoff folding device according to the present invention may be configured such that the drive cam includes a cam portion, a gear portion, and a connecting portion, the cam portion including on a circumferential surface thereof the endless cam surface, the gear portion having formed on a circumferential surface thereof a gear tooth, and the connecting portion being for connecting said cam portion and said gear portion, and the drive cam drive means includes an electric motor and a transmission gear mechanism, the transmission gear mechanism being for transmitting a rotational force of the electric motor to the gear portion of the drive cam.

In addition, the variable cutoff folding device according to the present invention may be configured such that the paper edge holding mechanism further comprises: a masking cam having a protruding portion formed protruding toward an outer side in a radial direction of the masking cam, the protruding portion having a radius which is substantially identical to that of the holding region of the endless cam surface of the drive cam and having a length in a circumferential direction which is not less than a length in a circumferential direction of the releasing region of said endless cam surface, a circumferential surface of the protruding portion forming a mask cam surface of the masking cam; a masking cam drive means for causing the masking cam to undergo angular displacement around the axial center of the folding cylinder; and a masking cam-dedicated cam follower connected to the paper holding pin and provided to be moveable over the mask cam surface of the masking cam, and the paper holding pin is configured such that, when at least one of the drive cam-dedicated cam follower and the masking cam-dedicated cam follower moves along the holding region of the endless cam surface of the drive cam or the mask cam surface of the masking cam, the tip of the paper holding pin projects further to the outer side in the radial direction of the folding cylinder than the circumferential surface of the folding cylinder.

Furthermore, the variable cutoff folding device according to the present invention may be configured such that the masking cam includes a cam portion, a gear portion, and a connecting portion, the cam portion including the protruding portion, the gear portion having formed on a circumferential surface thereof a gear tooth, and the connecting portion being for connecting said cam portion and said gear portion, and the masking cam drive means includes an electric motor and a transmission gear mechanism, the transmission gear mechanism being for transmitting a rotational force of the electric motor to the gear portion of the masking cam.

In addition, a printer according to the present invention comprises the above-described variable cutoff folding device.

The present invention makes it possible to provide a variable cutoff folding device that, accompanying a change in cutoff, allows a pin to be withdrawn from sheets at a suitable timing based on that cutoff, and a printer comprising this variable cutoff folding device.

DETAILED DESCRIPTION OF THE EMBODIMENTS

Preferred embodiments for carrying out the present invention are described below with reference to the drawings. The following embodiments are not intended to limit the inventions set forth in the claims, and the combinations of features described in the embodiments are not all necessarily indispensable for the means for solving the problem provided by the invention.

Figure 1:
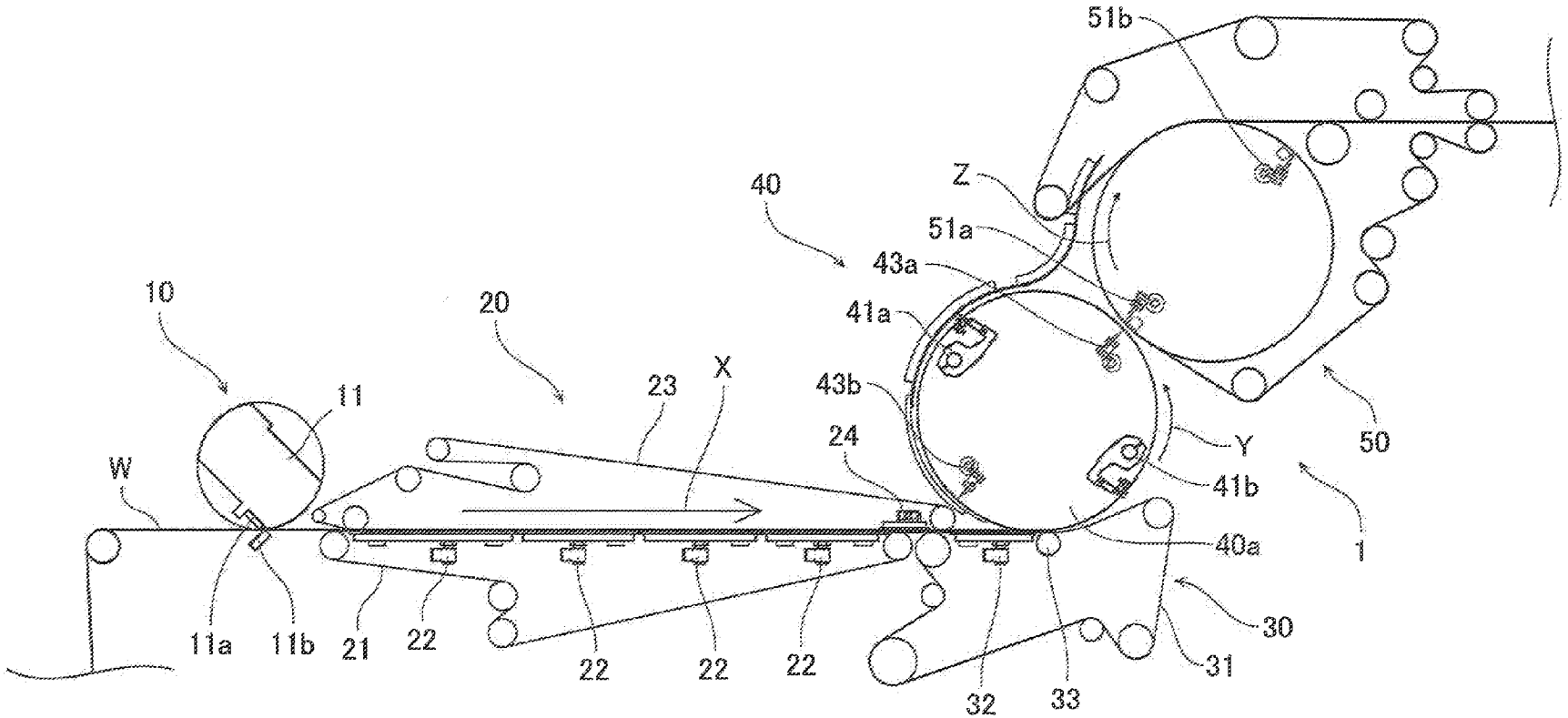
FIG. 1 is an elevation view showing schematically an overall configuration of a printer including a variable cutoff folding device according to a present embodiment, with a frame omitted.

As shown in FIG. 1, a printer according to a present embodiment comprises: a continuous paper supply unit (not illustrated) having roll paper set therein, the roll paper being continuous paper W wound in a roll shape; a digital printing unit (not illustrated) for performing digital printing on the continuous paper W supplied from the continuous paper supply unit; a cutting mechanism 10 for cutting the post-digital printing continuous paper W to form individual sheets FP (Flat Paper); a speed-increasing conveyor mechanism 20 and a downward-of-folding conveyor mechanism 30 for conveying the post-cutting individual sheets FP to a downstream side; and a variable cutoff folding device 1 including a folding cylinder 40 and a jaw cylinder 50, the folding cylinder 40 being for sequentially collecting the individual sheets FP conveyed from the speed-increasing conveyor mechanism 20 and downward-of-folding conveyor mechanism 30 (upstream side) by wrapping the individual sheets FP around the folding cylinder 40, and the jaw cylinder 50 being for receiving the individual sheets FP from the folding cylinder and conveying the individual sheets FP to the downstream side. In the printer according to the present embodiment, a variety of publicly known continuous paper supply units and digital printing units may be employed, hence descriptions of the continuous paper supply unit and the digital printing unit are omitted. Note that in FIG. 1, arrow X indicates a conveying direction of the individual sheets FP, arrow Y indicates a rotating direction of the folding cylinder 40, and arrow Z indicates a rotating direction of the jaw cylinder 50.

The individual sheets FP may be configured in a variety of sizes according to a type of the continuous paper W supplied and according to a change in cutoff (cutting length) due to the cutting mechanism 10.

A length in a width direction of the individual sheets FP is determined based on a length in a width direction of the continuous paper W supplied. Specifically, the length in the width direction is configured compatible with any of a Japanese broad sheet standard (546 mm) and a Japanese tabloid sheet standard (406.5 mm).

A length in a running direction of the individual sheets FP is changeable based on a change in cutoff. That is, the length in the running direction of the individual sheets FP differs from the length in the width direction of the individual sheets FP in being changeable based on an operational setting of the variable cutoff folding device 1. Specifically, the length in the running direction is configured compatible with any of a two section portion of a Japanese broad sheet standard (813 mm) and a two section portion of a Japanese tabloid sheet standard (546 mm).

In the present embodiment, a cutoff of a two section portion of a Japanese broad sheet standard (813 mm) is assumed to be a "maximum cutoff". Moreover, a time when the printer is operating with a setting where the individual sheets FP undergo maximum cutoff is referred to as "during maximum cutoff". On the other hand, a cutoff of a two section portion of a Japanese tabloid sheet standard (546 mm) is assumed to be a "minimum cutoff". Moreover, a time when the printer is operating in a state where the individual sheets FP undergo minimum cutoff is referred to as "during minimum cutoff".

The cutting mechanism 10 is configured including a cutter cylinder 11, a cutter blade 11*a*, and a cutter blade receiver 11*b*. Moreover, the cutting mechanism 10 cuts the supplied continuous paper W into the individual sheets FP.

The cutter cylinder 11 is formed with a certain circumferential length and comprises one cutter blade 11*a* protruding from an outer circumferential surface of the cutter cylinder 11. Moreover, the cutter cylinder 11 cuts the continuous paper W, supplied at the same speed as a circumferential speed of the cutter cylinder 11 during maximum cutoff, one time every one rotation.

The circumferential length of the cutter cylinder 11 is configured to be the same length as the length in the running direction of the individual sheets FP during maximum cutoff. Moreover, if the cutter cylinder 11 rotates having a circumferential speed of the cutter cylinder 11 which is the same speed as the continuous paper W, the individual sheets FP can be configured maximum cutoff.

The cutter cylinder 11 includes a control means for changing the circumferential speed. Changing the circumferential speed of the cutter cylinder 11 results in a spacing at which the cutter blade 11*a* reaches a cutting position changing along with a change in the circumferential speed of the cutter cylinder 11. That is, the variable cutoff folding device 1 is configured capable of changing the circumferential speed of the cutter cylinder 11 to an arbitrary speed, whereby the variable cutoff folding device 1 is configured to change cutoff of the continuous paper W to an arbitrary cutting length of from "maximum cutoff" to "minimum cutoff".

The speed-increasing conveyor mechanism 20 is configured including a lower conveyor belt 21, a lower suction device 22, an upper conveyor belt 23, and an upper suction device 24. In addition, the speed-increasing conveyor mechanism 20 conveys the individual sheets FP cut by the cutting mechanism 10 toward the downward-of-folding conveyor mechanism 30. Moreover, the speed-increasing conveyor mechanism 20 conveys the individual sheets FP at a speed which is faster than the conveying speed of the continuous paper W supplied to the cutting mechanism 10.

The speed-increasing conveyor mechanism 20 is configured capable of changing a conveying speed to an arbitrary speed. The conveying speed of the speed-increasing conveyor mechanism 20 is slowest during maximum cutoff and fastest during minimum cutoff. When the conveying speed of the speed-increasing conveyor mechanism 20 is slowest (during maximum cutoff), the speed-increasing conveyor mechanism 20 conveys at a conveying speed which is, for example, several percent faster than the conveying speed of the continuous paper W up to the cutting mechanism 10. On the other hand, when the conveying speed of the speed-increasing conveyor mechanism 20 is fastest (during minimum cutoff), the speed-increasing conveyor mechanism 20 conveys at a conveying speed which is, for example, 1.5 times that during maximum cutoff.

Figure 2:
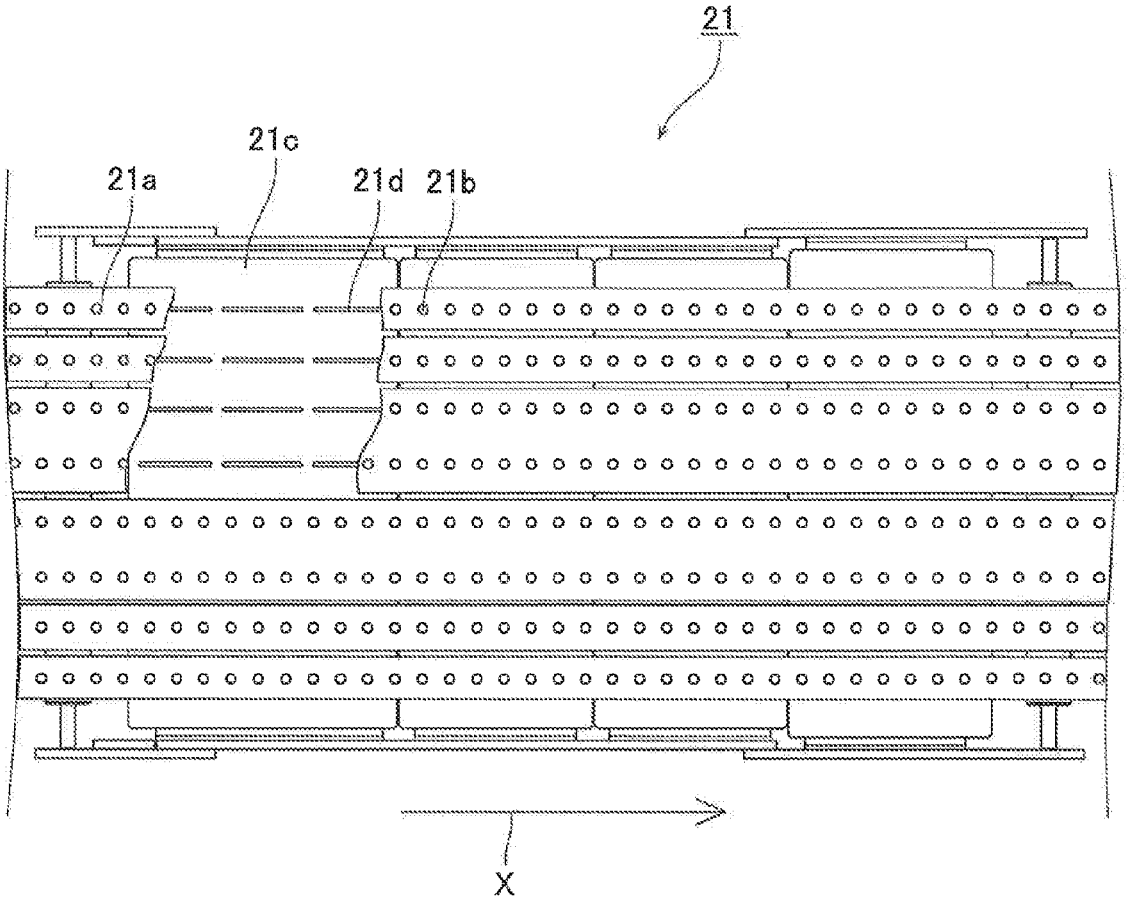
FIG. 2 is a plan view showing a partially cutout schematic configuration of a lower conveyor belt.

FIG. 2 is a view showing an example of configuration of the lower conveyor belt. As shown in FIG. 2, the lower conveyor belt 21 includes a belt portion 21*a*, a belt portion suction hole 21*b*, a top plate 21*c*, and a top plate suction hole 21*d*. Moreover, the lower conveyor belt 21 is a conveyor mechanism installed in a lower portion of a conveying path of the individual sheets FP. The lower conveyor belt 21, along with an upper conveyor belt 23, conveys the individual sheets FP by sandwiching the individual sheets FP between the lower conveyor belt 21 and upper conveyor belt 23.

The belt portion 21*a* is a belt suspended by a plurality of rollers. The belt portion 21*a* forms a certain path by being suspended by the plurality of rollers and circuits using a rotational driving force of the rollers as a power source. This certain path includes a path of passage of the individual sheets FP. The path of passage of the individual sheets FP in the lower conveyor belt 21 is from directly after the cutting mechanism 10 to a most upstream position of the downward-of-folding conveyor mechanism 30.

As shown in FIG. 2, the belt portion suction hole 21*b* is a circular-shaped round hole formed in the belt portion 21*a*. Moreover, the belt portion suction holes 21*b* are formed with a certain pitch in parallel to the running direction of the individual sheets FP, and are formed in a plurality of columns. In view of a length in the running direction of the individual sheets FP conveyed, in order to convey the individual sheets FP stably, a pitch in the long direction of the belt portion suction holes 21*b* is preferably about 25 mm.

The top plate 21*c* is installed on an inner side of the lower conveyor belt 21 and is installed directly below a conveying path along which the individual sheets FP pass in the lower conveyor belt 21. The top plate 21*c* is fixed to the likes of a frame of the entire printer, or a frame installed in the variable cutoff folding device 1. Moreover, the top plate 21*c* fixes the lower suction device 22.

The top plate suction hole 21*d* is a slit hole formed in the top plate 21*c*. Moreover, the top plate suction holes 21*d* are formed with a certain pitch in parallel to the running direction of the individual sheets FP, and are formed in a plurality of columns.

Columns formed in parallel to the running direction of the belt portion suction hole 21*b* and columns formed in parallel to the running direction of the top plate suction hole 21*d* are formed such that respective columns overlap. Therefore, when the belt portion 21*a* is being driven, the belt portion suction hole 21*b* necessarily passes above the top plate suction hole 21*d*, hence the variable cutoff folding device 1 makes it possible for suction power from the lower suction device 22 to be transmitted to the individual sheets FP via the belt portion suction hole 21*b*, thereby making it possible for the individual sheets FP to be conveyed while being restrained.

A plurality of the lower suction devices 22 are installed below the path of passage of the individual sheets FP in the lower conveyor belt 21. Since the lower suction device 22 is fixed to the top plate forming the lower conveyor belt 21 and is not fixed directly to the belt portion 21*a*, the lower suction device 22 itself does not move. Moreover, suction power of the lower suction device 22 is transmitted to the individual sheets FP via the belt portion suction hole 21*b*. Such a configuration enables the individual sheets FP cut and rendered in sheet form to be conveyed reliably in a restrained state.

The upper conveyor belt 23 is a belt installed in an upper portion of the conveying path of the individual sheets FP. The upper conveyor belt 23, along with the lower conveyor belt 21, conveys the individual sheets FP by sandwiching the individual sheets FP between the upper conveyor belt 23 and lower conveyor belt 21. Moreover, the upper conveyor belt 23 circuits a certain path formed by a plurality of rollers, using a rotational driving force of the rollers as a power source. This certain path includes from directly after the cutting mechanism 10 to a position where a return roller does not contact the folding cylinder 40. That is, the upper conveyor belt 23 is configured having a conveying path of the individual sheets FP up to a position more on a downstream side than that of the lower conveyor belt 21.

The upper suction device 24 is a suction device installed at a most downstream position of the lower conveyor belt 21 in the speed-increasing conveyor mechanism 20. Due to a relationship of installation between the rollers driving the lower conveyor belt 21 and rollers driving the downward-of-folding conveyor mechanism 30, space for installing the lower suction device 22 cannot be secured between the lower conveyor belt 21 in the speed-increasing conveyor mechanism 20 and the downward-of-folding conveyor mechanism 30. Therefore, since the individual sheets FP cannot be conveyed in a restrained state between the lower conveyor belt 21 in the speed-increasing conveyor mechanism 20 and the downward-of-folding conveyor mechanism 30, conveying trouble may occur. Accordingly, adopting a configuration where the upper suction device 24 is installed in an upper position of the conveying path to suction the individual sheets FP results in bridging between the speed-increasing conveyor mechanism 20 and the downward-of-folding conveyor mechanism 30 being performed without conveying trouble.

The downward-of-folding conveyor mechanism 30 is a belt conveyor installed downstream of the speed-increasing conveyor mechanism 20 and upstream of the folding cylinder 40. Moreover, the downward-of-folding conveyor mechanism 30 is configured including a downward-of-folding conveyor belt 31, a downward-of-folding suction device 32, and a pin receiving roller 33. The downward-of-folding conveyor belt 31 circuits a certain path formed by a plurality of rollers including the pin receiving roller 33, using a rotational driving force of the rollers as a power source. This certain path includes from a most downstream position of the speed-increasing conveyor mechanism 20 to a position where a later-described paper edge holding mechanism 41 installed in the folding cylinder 40 operates.

A driving speed of the downward-of-folding conveyor mechanism 30 is configured to be identical to a circumferential speed of the folding cylinder 40. As a result of such a configuration, when the folding cylinder 40 catches the individual sheets FP conveyed from the downward-of-folding conveyor mechanism 30, the individual sheets FP are enabled to be wrapped around the folding cylinder 40 in a state where a moving speed of the individual sheets FP and the circumferential speed of the folding cylinder 40 are set to the same speed, thereby enabling the individual sheets FP to be wrapped around the folding cylinder 40 without causing twisting, blockage, or the like. Therefore, the folding cylinder 40 is enabled to reliably collect the individual sheets FP, thereby making it possible to prevent a lowering of operating efficiency.

The downward-of-folding suction device 32 is a suction device for suctioning the individual sheets FP from a lower portion of the conveying path of the individual sheets FP. The downward-of-folding suction device 32 takes over restraint of the individual sheets FP from the upper suction device 24. Such a configuration enables the individual sheets FP to be conveyed in a restrained state without being set in a free state, thereby enabling stable conveying of the individual sheets FP. Therefore, conveying trouble can be prevented.

The pin receiving roller 33 is configured including a groove portion (not illustrated). In addition, the pin receiving roller 33 is supported rotatably and in parallel to an axis of the folding cylinder 40. Moreover, since the pin receiving roller 33 is set such that a spacing between the pin receiving roller 33 and the folding cylinder 40 is narrow, when a paper holding pin 52*a* (52*b*) of a paper edge holding mechanism 41*a* (41*b*) has stabbed and penetrated the received individual sheets FP, a tip side of the penetrating paper holding pin 52*a* (52*b*) is caused to enter the groove portion, whereby the paper holding pin 52*a* (52*b*) of the paper edge holding mechanism 41*a* (41*b*) is enabled to reliably stab a flimsy sheet. Therefore, the folding cylinder 40 is enabled to reliably collect the individual sheets FP, thereby making it possible to prevent a lowering of operating efficiency.

As shown in FIG. 1 and FIGS. 3 to 5, the folding cylinder 40 comprises: a folding cylinder main body 40*a*; the two paper edge holding mechanisms (pin devices) 41*a* and 41*b* installed at positions bisecting the folding cylinder main body 40*a* in a circumferential direction; stoppers 42 and 42 provided adjacently to each of the paper edge holding mechanisms 41*a* and 41*b*; and two thrust blade mechanisms (thrust blade devices) 43*a* and 43*b* installed capable of moving along a circumferential surface of the folding cylinder main body 40*a*. The folding cylinder 40 is installed downstream of the downward-of-folding conveyor mechanism 30 and upstream of the jaw cylinder 50.

Figure 4:
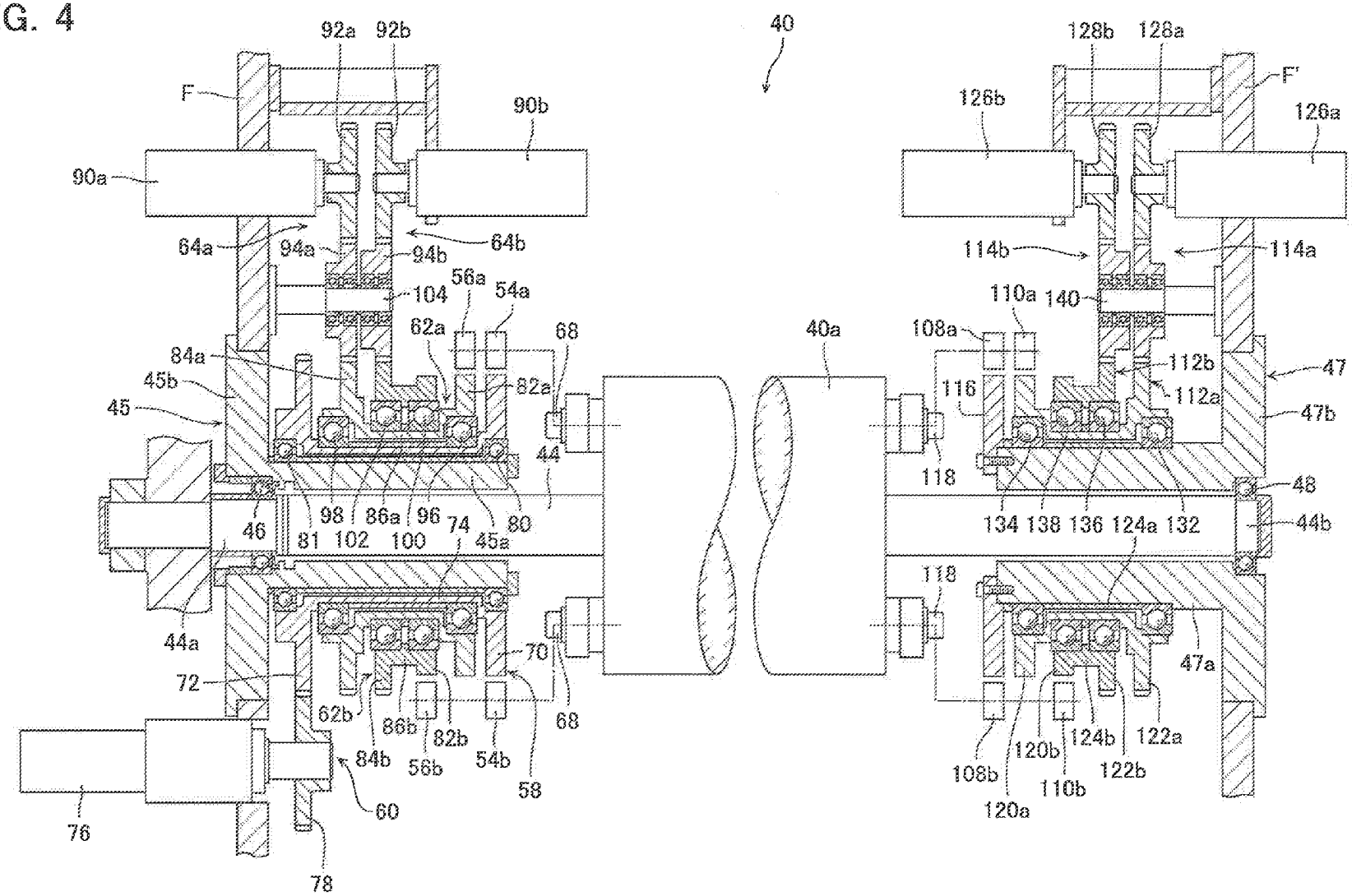
FIG. 4 is a cross-sectional lateral development elevation view showing schematically an internal structure of the variable cutoff folding device according to the present embodiment, with partial omissions.

As shown in FIG. 4, the folding cylinder main body 40*a* is formed in a cylindrical shape and has a rotating shaft 44 provided penetrating the folding cylinder main body 40*a* so as to be coaxial to an axial center of the folding cylinder main body 40*a*. A length of a half circumference of the folding cylinder main body 40*a* is configured to be longer than "a length of the individual sheets FP during maximum cutoff+a length in a rotating direction of the stopper 42". Therefore, the folding cylinder 40 according to the present embodiment is configured to collect one of the individual sheets FP by wrapping the individual sheet FP around the folding cylinder 40 every half rotation of the folding cylinder 40.

The rotating shaft 44 has one end 44*a* rotatably supported in a shaft bearing sleeve 45 attached to one side (frame F) of an opposing pair of frames F and F', via a shaft bearing 46, and has the other end 44*b* rotatably supported in a shaft bearing sleeve 47 attached to the other side (frame F') of the opposing pair of frames F and F', via a shaft bearing 48. This rotating shaft 44 has its one end 44*a* connected to a drive means not illustrated and is configured to rotate by this drive means being driven and to rotate the folding cylinder main body 40*a* centered around the axial center of the folding cylinder main body 40*a*. A circumferential speed of this folding cylinder main body 40*a* is appropriately adjustable based on the length (cutoff) in the conveying direction of the individual sheets FP so as to be a speed at which a leading edge of the individual sheets FP conveyed sequentially from the speed-increasing conveyor mechanism 20 and the downward-of-folding conveyor mechanism 30 contacts each of the stoppers 42. Such adjustment of the circumferential speed of the folding cylinder main body 40*a* may adopt a configuration where setting is performed manually in advance, or may adopt a configuration where adjustment is made automatically by incorporating a control device.

The shaft bearing sleeves 45 and 47 include, respectively, cylindrical portions 45*a* and 47*a* formed in a cylindrical shape, and flange portions 45*b* and 47*b* protruding outwardly in a radial direction from one ends of the cylindrical portions 45*a* and 47*a*, the flange portions 45*b* and 47*b* being attached to attachment holes of the frames F and F' such that the cylindrical portions 45*a* and 47*a* protrude toward the folding cylinder main body 40*a* (that is, toward a device interior of the variable cutoff folding device 1). These cylindrical portions 45*a* and 47*a* each have a radius allowing insertion of the rotating shaft 44 of the folding cylinder 40, and are internally embedded with shaft bearings 46 and 48 that rotatably support the rotating shaft 44.

Figure 3:
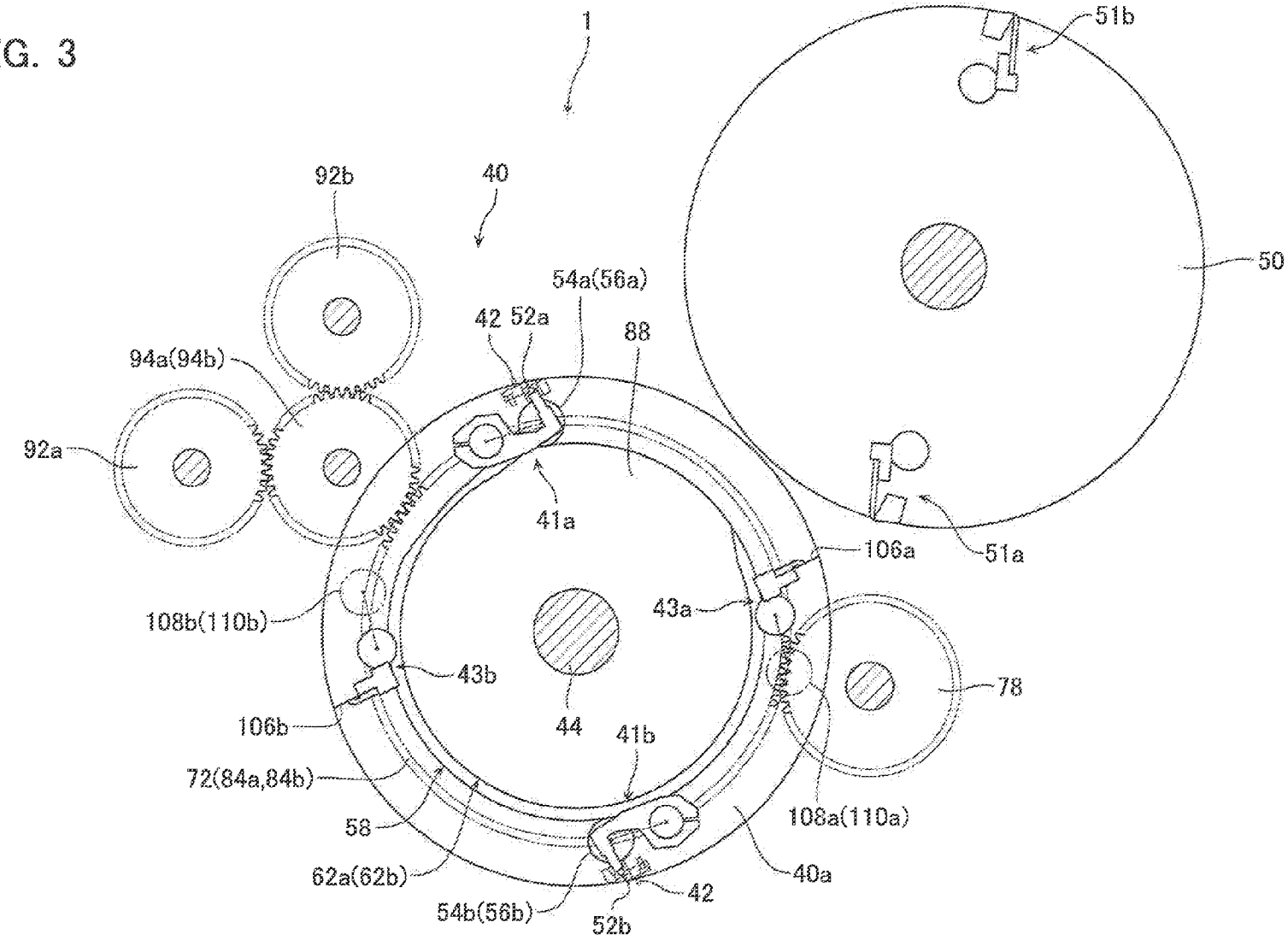
FIG. 3 is a view showing schematically a dispositional relationship of each of configurations of the variable cutoff folding device according to the present embodiment, with partial omissions.
Figure 5:
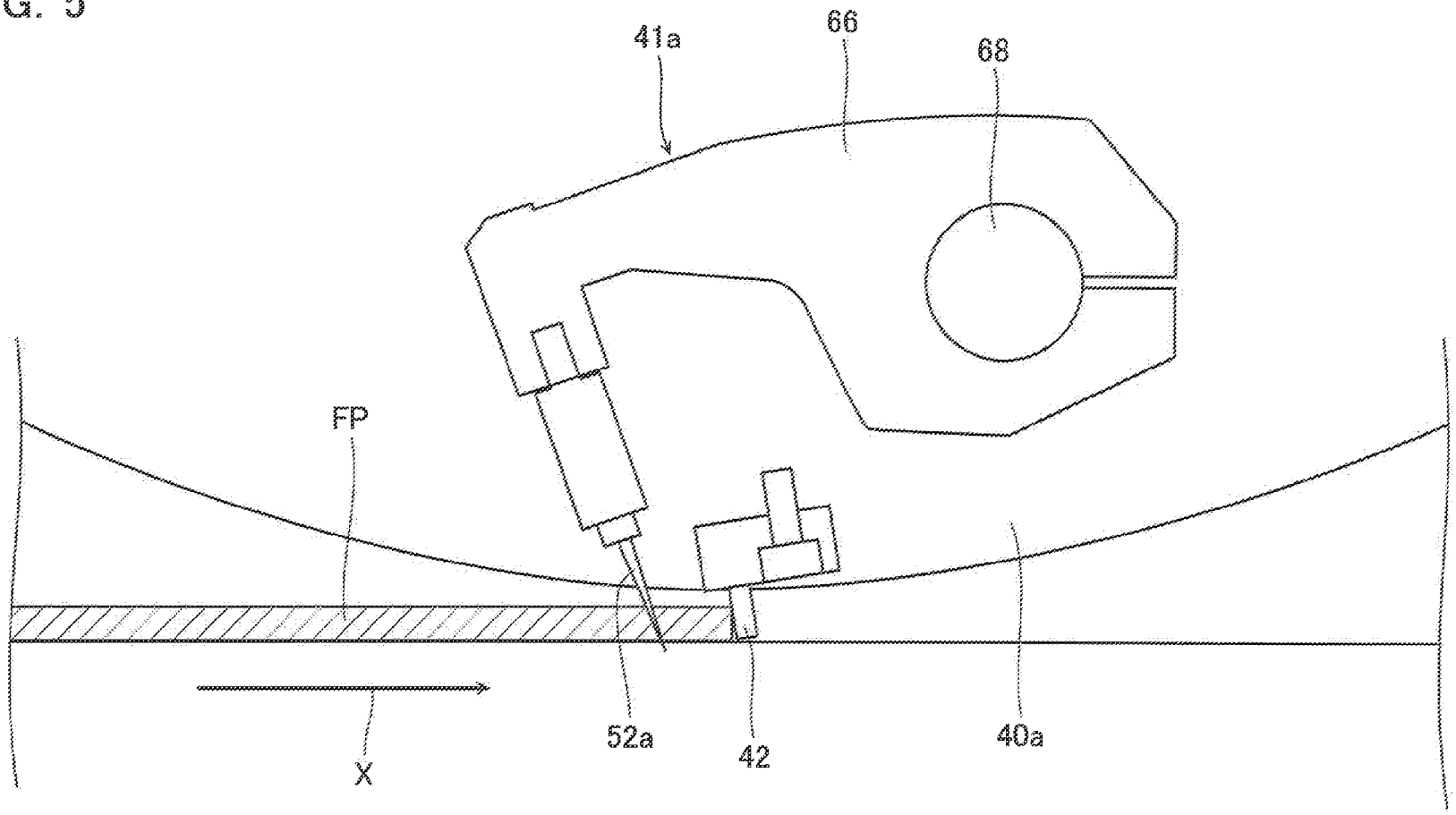
FIG. 5 is an enlarged view showing a schematic configuration of a paper edge holding mechanism and a stopper.

As shown in FIGS. 3 to 5, the paper edge holding mechanisms 41*a* and 41*b* comprise, respectively, a plurality of paper holding pins 52*a* and 52*b*, drive cam-dedicated cam followers 54*a* and 54*b*, masking cam-dedicated cam followers 56*a* and 56*b*, masking cams 62*a* and 62*b*, and masking cam drive means 64*a* and 64*b*. In addition, the paper edge holding mechanisms 41*a* and 41*b* comprise one drive cam 58 and one drive cam drive means 60 as configurations shared by the two paper edge holding mechanisms 41*a* and 41*b*. As shown in FIG. 3, the paper holding pins 52*a* and 52*b* are provided built in to a close vicinity of an outer circumferential surface of the folding cylinder main body 40*a*, and, as shown in FIG. 4, the drive cam-dedicated cam followers 54*a* and 54*b*, the masking cam-dedicated cam followers 56*a* and 56*b*, the drive cam 58, the drive cam drive means 60, the masking cams 62*a* and 62*b*, and the masking cam drive means 64*a* and 64*b* are provided between the folding cylinder main body 40*a* and one of the frames, namely frame F.

Each of the paper holding pins 52*a* and 52*b* is formed in a pin shape capable of stabbing the individual sheets FP, and is held by a pin holder 66. The pin holder 66 is attached to a pin support shaft 68 provided parallel to the axial center of the folding cylinder main body 40*a* and is configured to swing to-and-fro in a direction orthogonal to the circumferential surface of the folding cylinder main body 40*a* centered around the pin support shaft 68 based on to-and-fro angular displacement of the pin support shaft 68, and thereby project (advance) or retract (withdraw) the tip of the paper holding pin 52*a* and 52*b* from the circumferential surface of the folding cylinder main body 40*a*. As shown in FIG. 4, one end of the pin support shaft 68 protrudes from a side surface of the folding cylinder main body 40*a*, moreover, attached to this one end, via an arm, are the drive cam-dedicated cam follower 54*a* (54*b*) and the masking cam-dedicated cam follower 56*a* (56*b*).

The drive cam-dedicated cam followers 54*a* and 54*b* are provided at the one end of the pin support shaft 68 at positions enabling movement along a later-described endless cam surface of the drive cam 58. The masking cam-dedicated cam followers 56*a* and 56*b* are provided at the one end of the pin support shaft 68 at positions enabling movement over a later-described mask cam surface of the masking cams 62*a* and 62*b*.

Each of the paper holding pins 52*a* and 52*b* is configured such that, due to the paper holding pin 52*a* (52*b*) being connected to the drive cam-dedicated cam follower 54*a* (54*b*) and the masking cam-dedicated cam follower 56*a* (56*b*) via the pin holder 66 and the pin support shaft 68 in this way, while at least one of the drive cam-dedicated cam follower 54*a* (54*b*) and the masking cam-dedicated cam follower 56*a* (56*b*) is moving along a later-described holding region A of the endless cam surface of the drive cam 58 or along the later-described mask cam surface of the masking cam 62*a* (62*b*), the tip of the paper holding pin 52*a* (52*b*) projects further to the outer side in the radial direction of the folding cylinder main body 40*a* than the circumferential surface of the folding cylinder main body 40*a*. On the other hand, each of the paper holding pins 52 is configured such that while the drive cam-dedicated cam follower 54 is moving along a later-described releasing region B of the endless cam surface of the drive cam 58, the tip of the paper holding pin 52 retracts further to an inner side in the radial direction of the folding cylinder main body 40*a* than the circumferential surface of the folding cylinder main body 40*a*.

Figure 9A:
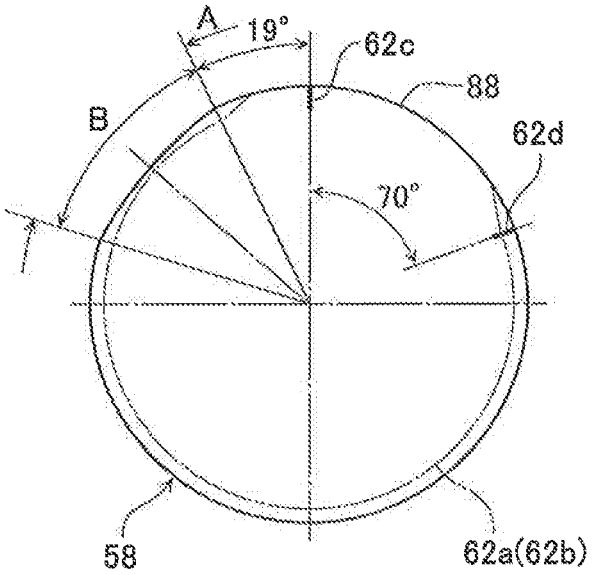
FIG. 9A is a view showing a positional relationship of a drive cam and a masking cam in a state where a releasing region of the drive cam is not masked by the masking cam, during maximum cutoff.
Figure 9B:
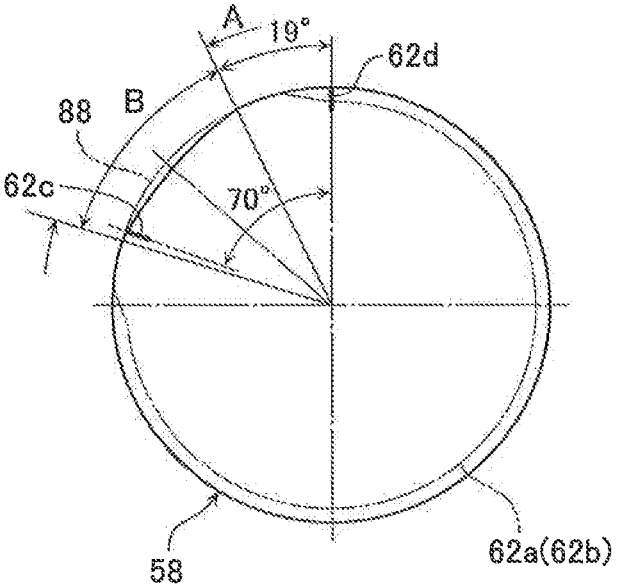
FIG. 9B is a view showing a positional relationship of the drive cam and the masking cam in a state where the releasing region of the drive cam is masked by the masking cam, during maximum cutoff.

As shown in FIG. 4, the drive cam 58 includes: a cam portion 70 including on a circumferential surface thereof the endless cam surface; a gear portion 72 having formed on a circumferential surface thereof a gear tooth; and a connecting portion 74 for connecting these cam portion 70 and gear portion 72. The endless cam surface of the cam portion 70 is formed from the holding region A having a certain radius, and the releasing region (pin retracting region) B having a radius which is smaller than that of the holding region A (refer to FIG. 9, and so on). Regarding a ratio of the holding region A and the releasing region B with respect to an entire region in the circumferential direction (360°) in the endless cam surface, for example, a range of 300° in the circumferential direction may be configured as the holding region A, and a range of 60° in the circumferential direction may be configured as the releasing region B (refer to FIG. 9, and so on). The gear portion 72 has formed therein gear teeth that mesh with a later-described transmission gear 78 of the drive cam drive means 60, and is configured such that rotational force of a later-described electric motor 76 mediated by the transmission gear 78 is transmitted to the gear portion 72. The connecting portion 74 is formed in a cylindrical shape having a radius allowing insertion of the cylindrical portion 45*a* of the shaft bearing sleeve 45, and is installed coaxially above the circumferential surface of the cylindrical portion 45*a* of the shaft bearing sleeve 45 via the shaft bearings 80 and 80 such that the cam portion 70 is positioned on a folding cylinder main body 40*a* side. The drive cam 58 is configured capable of angular displacement around the axial center of the folding cylinder main body 40*a* by rotational force of the electric motor 76 being transmitted via the transmission gear 78.

The drive cam drive means 60 comprises: the electric motor 76 attached to one of the frames, namely frame F; and the transmission gear (transmission gear mechanism) 78 connected to an output shaft of the electric motor 76. The electric motor 76 has an encoder built in, and is configured such that rotational phase control of the cam portion 70 of the drive cam 58 is executed based on a detection value of this encoder. Such rotational phase control may be executed based on an arbitrary setting value appropriate to a predetermined cutoff (length in the conveying direction) of the individual sheets FP, or may be executed automatically based on an operating signal appropriately outputted according to cutoff (length in the conveying direction) of the individual sheets FP subject to conveying. The transmission gear 78 is disposed to mesh with the gear portion 72 of the drive cam 58, and is configured to transmit rotational force of the electric motor 76 to the gear portion 72 of the drive cam 58. In this way, the drive cam drive means 60 is configured capable of causing the drive cam 58 to be angularly displaced around the axial center of the folding cylinder main body 40*a*.

The masking cam 62*a* (62*b*) includes: a cam portion 82*a* (82*b*) including on part of a circumferential surface thereof the mask cam surface; a gear portion 84*a* (84*b*) having formed on a circumferential surface thereof a gear tooth; and a connecting portion 86*a* (86*b*) for connecting these cam portion 82*a* (82*b*) and gear portion 84*a* (84*b*). The cam portion 82*a* (82*b*) is formed such that a protruding portion 88 having a radius substantially identical to that of the holding region A of the endless cam surface of the drive cam 58 and having a length in a circumferential direction not less than a length in the circumferential direction of the releasing region B of this endless cam surface protrudes toward an outer side in a radial direction. A circumferential surface of this protruding portion 88 forms the mask cam surface. The gear portion 84*a* (84*b*) has formed therein gear teeth that mesh with a later-described second transmission gear 94*a* (94*b*) of the corresponding masking cam drive means 64*a* (64*b*), and is configured such that rotational force of a later-described electric motor 90*a* (90*b*) mediated by the second transmission gear 94*a* (94*b*) is transmitted to the gear portion 84*a* (84*b*).

The connecting portion 86*a* of one of the masking cams 62*a* is formed in a cylindrical shape having a radius allowing insertion of the connecting portion 74 of the drive cam 58, and is installed coaxially above a circumferential surface of the connecting portion 74 of the drive cam 58 via shaft bearings 96 and 98 such that the cam portion 82*a* is positioned on a folding cylinder main body 40*a* side. The one of the masking cams 62*a* is configured capable of angular displacement around the axial center of the folding cylinder main body 40*a* by rotational force of the electric motor 90*a* being transmitted via a transmission gear mechanism configured from a later-described first transmission gear 92*a* and the second transmission gear 94*a*.

The connecting portion 86*b* of the other of the masking cams 62*b* is formed in a cylindrical shape having a radius allowing insertion of the connecting portion 86*a* of the one of the masking cams 62*a*, and is installed coaxially above a circumferential surface of the connecting portion 86*a* of the one of the masking cams 62*a* via shaft bearings 100 and 102 such that the cam portion 82*b* is positioned on a folding cylinder main body 40*a* side. The other of the masking cams 62*b* is configured capable of angular displacement around the axial center of the folding cylinder main body 40*a* by rotational force of the electric motor 90*b* being transmitted via a transmission gear mechanism configured from a later-described first transmission gear 92*b* and the second transmission gear 94*b*.

The masking cam drive means 64*a* (64*b*) comprises: the electric motor 90*a* (90*b*) attached directly or indirectly to one of the frames, namely frame F; and the transmission gear mechanism for transmitting rotational force of the electric motor 90*a* (90*b*) to the gear portion 84*a* (84*b*) of the masking cam 62*a* (62*b*). The electric motor 90*a* (90*b*) has an encoder built in, and is configured such that rotational phase control of the cam portion 82*a* (82*b*) of the masking cam 62*a* (62*b*) is respectively executed based on a detection value of this encoder. Such rotational phase control may be executed by an appropriately outputted operating signal, for example, a predetermined operating signal outputted from an appropriate signal output means, or by satisfaction of "AND"

between this operating signal and a detection signal outputted based on a detection value of a detecting means for detecting rotational phase of the folding cylinder 40. The transmission gear mechanism comprises: the first transmission gear 92*a* (92*b*) connected to an output shaft of the electric motor 90*a* (90*b*); and the second transmission gear 94*a* (94*b*) that meshes with both of the first transmission gear 92*a* (92*b*) and the gear portion 84*a* (84*b*) of the masking cam 62*a* (62*b*). The second transmission gear 94*a* (94*b*) is attached via shaft bearings to a shaft 104 provided protruding to an inner side of the device from the one of the frames, namely frame F. Each of the masking cam drive means 64*a* and 64*b* is configured capable of independently causing the corresponding masking cams 62*a* and 62*b* to be angularly displaced around the axial center of the folding cylinder main body 40*a*.

The paper edge holding mechanisms 41*a* and 41*b* comprising the above kind of configurations enable a position in a circumferential direction of the releasing region (pin retracting region) B of the endless cam surface of the cam portion 70 of the drive cam 58 to be changed to an arbitrary position, by the drive cam being angularly displaced around the axial center of the folding cylinder main body 40*a* by the drive cam drive means 60, hence allow timing of releasing holding of the individual sheets FP to be changed based on cutoff (length in the conveying direction) of the individual sheets FP.

In addition, the paper edge holding mechanisms 41*a* and 41*b* comprising the above kind of configurations enable a position in a circumferential direction of the protruding portion 88 of the cam portion 82*a* (82*b*) of the masking cam 62*a* (62*b*) to be aligned with a position in a circumferential direction of the releasing region (pin retracting region) B of the endless cam surface of the cam portion 70 of the drive cam 58 to disable the releasing region (pin retracting region) B, by the masking cam 62*a* (62*b*) being angularly displaced around the axial center of the folding cylinder main body 40*a* by the masking cam drive means 64*a* (64*b*). As a result, holding of the individual sheets FP by the paper edge holding mechanisms 41*a* and 41*b* can be continued to an arbitrary timing, thereby enabling a collect run of an arbitrary number of two or more stacked sheets to be executed.

As shown in FIG. 5, the stopper 42 is provided forming a pair with each of the paper edge holding mechanisms 41*a* and 41*b* and is installed on a downstream side (in terms of rotating direction, a forward direction side) of when the paper holding pins 52*a* and 52*b* of the paper edge holding mechanisms 41*a* and 41*b* protrude to an outer side in a radial direction from the circumferential surface of the folding cylinder main body 40*a*. Such a configuration makes it possible for a head position of the conveyed individual sheets FP to be fixed and for the paper holding pins 52*a* and 52*b* to be stabbed accurately in a leading edge in the conveying direction of the individual sheets FP, thereby enabling a high precision signature to be produced.

Two thrust blade mechanisms 43*a* and 43*b* are installed with equal spacing at an outer circumference of the folding cylinder main body 40*a* and are configured to cause thrust blades 106*a* and 106*b* to protrude thereby causing a sheet group configured from one individual sheet FP or an arbitrary number of two or more stacked individual sheets FP and held (collected) by the paper edge holding mechanisms 41*a* and 41*b*, to be gripped by the jaw cylinder 50. The thrust blade mechanisms 43*a* and 43*b* are configured to cause the thrust blades 106*a* and 106*b* to protrude at a position of smallest distance between the folding cylinder 40 and the jaw cylinder 50.

Specifically, as shown in FIGS. 3 and 4, the thrust blade mechanisms 43*a* and 43*b* comprise, respectively, the thrust blades 106*a* and 106*b*, drive cam-dedicated cam followers 108*a* and 108*b*, masking cam-dedicated cam followers 110*a* and 110*b*, masking cams 112*a* and 112*b*, and masking cam drive means 114*a* and 114*b*. In addition, the thrust blade mechanisms 43*a* and 43*b* comprise one drive cam 116 as a configuration shared by the two thrust blade mechanisms 43*a* and 43*b*. As shown in FIG. 3, the thrust blades 106*a* and 106*b* are provided built in to a close vicinity of an outer circumferential surface of the folding cylinder main body 40*a*, and, as shown in FIG. 4, the drive cam-dedicated cam followers 108*a* and 108*b*, the masking cam-dedicated cam followers 110*a* and 110*b*, the masking cams 112*a* and 112*b*, the masking cam drive means 114*a* and 114*b*, and the drive cam 116 are provided between the folding cylinder main body 40*a* and the other of the frames, namely frame F'.

Each of the thrust blades 106*a* and 106*b* is formed in a blade shape capable of projecting the individual sheets FP (including the sheet group) to an outer side in a radial direction, and is attached to a thrust blade support shaft 118 provided parallel to the axial center of the folding cylinder main body 40*a*. Each of the thrust blades 106*a* and 106*b* is configured to swing to-and-fro in a direction orthogonal to the circumferential surface of the folding cylinder main body 40*a* centered around the thrust blade support shaft 118 based on to-and-fro angular displacement of the thrust blade support shaft 118, and thereby project (advance) or retract (withdraw) a leading edge of the thrust blades 106*a* and 106*b* from the circumferential surface of the folding cylinder main body 40*a*. As shown in FIG. 4, one end of the thrust blade support shaft 118 protrudes from a side surface of the folding cylinder main body 40*a*, moreover, attached to this one end, via an arm, are the drive cam-dedicated cam follower 108*a* (108*b*) and the masking cam-dedicated cam follower 110*a* (110*b*).

The drive cam-dedicated cam followers 108*a* and 108*b* are provided at the one end of the thrust blade support shaft 118 at positions enabling movement along a later-described endless cam surface of the drive cam 116. The masking cam-dedicated cam followers 110*a* and 110*b* are provided at the one end of the thrust blade support shaft 118 at positions enabling movement over a later-described mask cam surface of the masking cams 112*a* and 112*b* corresponding respectively to the masking cam-dedicated cam followers 110*a* and 110*b*.

Each of the thrust blades 106*a* and 106*b* is configured such that, due to the thrust blade 106*a* (106*b*) being connected to the drive cam-dedicated cam follower 108*a* (108*b*) and the masking cam-dedicated cam follower 110*a* (110*b*) via the thrust blade support shaft 118 in this way, while at least one of the drive cam-dedicated cam follower 108*a* (108*b*) and the masking cam-dedicated cam follower 110*a* (110*b*) is moving along a later-described withdrawing region of the endless cam surface of the drive cam 116 or along the later-described mask cam surface of the masking cam 112*a* (112*b*), the leading edge of the thrust blade 106*a* (106*b*) withdraws further to an inner side in the radial direction of the folding cylinder main body 40*a* than the circumferential surface of the folding cylinder main body 40*a*. On the other hand, each of the thrust blades 106*a* and 106*b* is configured such that while the drive cam-dedicated cam follower 108*a* (108*b*) is moving along a later-described advancing region of the endless cam surface of the drive cam 116, the leading edge of the thrust blade 106*a* (106*b*) advances further to the outer side in the radial direction of the folding cylinder main body 40*a* than the circumferential surface of the folding cylinder main body 40*a*.

As shown in FIG. 4, the drive cam 116 is formed in an annular shape having at a center thereof a hole allowing insertion of the rotating shaft 44 of the folding cylinder main body 40*a*, and is fixed to a leading end portion of the cylindrical portion 47*a* of the shaft bearing sleeve 47 by a fastening member, for example, a screw, such that a center of the hole aligns with the axial center of the folding cylinder main body 40*a*. In addition, the drive cam 116 includes on a circumferential surface thereof the withdrawing region having a certain radius, and the advancing region (blade projecting region) having a radius which is smaller than that of the withdrawing region. The endless cam surface of the drive cam 116 may be formed in substantially the same shape as the endless cam surface of the drive cam 58 of the paper edge holding mechanisms 41*a* and 41*b*.

The masking cam 112*a* (112*b*) includes: a cam portion 120*a* (120*b*) including on part of a circumferential surface thereof the mask cam surface; a gear portion 122*a* (122*b*) having formed on a circumferential surface thereof a gear tooth; and a connecting portion 124*a* (124*b*) for connecting the cam portion 120*a* (120*b*) and the gear portion 122*a* (122*b*). The cam portion 120*a* (120*b*) is formed such that a protruding portion (not illustrated) having a radius substantially identical to that of the withdrawing region of the endless cam surface of the drive cam 116 and having a length in a circumferential direction not less than a length in the circumferential direction of the advancing region of this endless cam surface protrudes toward an outer side in a radial direction. A circumferential surface of this protruding portion forms the mask cam surface. The gear portion 122*a* (122*b*) has formed therein gear teeth that mesh with a later-described second transmission gear 130*a* (130*b*) of the corresponding masking cam drive means 114*a* (114*b*), and is configured such that rotational force of a later-described electric motor 126*a* (126*b*) mediated by the second transmission gear 130*a* (130*b*) is transmitted to the gear portion 122*a* (122*b*).

The connecting portion 124*a* of one of the masking cams 112*a* is formed in a cylindrical shape having a radius allowing insertion of the cylindrical portion 47*a* of the shaft bearing sleeve 47, and is installed coaxially above a circumferential surface of the cylindrical portion 47*a* of the shaft bearing sleeve 47 via shaft bearings 132 and 134 such that the cam portion 120*a* is positioned on a folding cylinder main body 40*a* side. The one of the masking cams 112*a* is configured capable of angular displacement around the axial center of the folding cylinder main body 40*a* by rotational force of the electric motor 126*a* being transmitted via a transmission gear mechanism configured from a later-described first transmission gear 128*a* and the second transmission gear 130*a*.

The connecting portion 124*b* of the other of the masking cams 112*b* is formed in a cylindrical shape having a radius allowing insertion of the connecting portion 124*a* of the one of the masking cams 112*a*, and is installed coaxially above a circumferential surface of the connecting portion 124*a* of the one of the masking cams 112*a* via shaft bearings 136 and 138 such that the cam portion 120*b* is positioned on a folding cylinder main body 40*a* side. The other of the masking cams 112*b* is configured capable of angular displacement around the axial center of the folding cylinder main body 40*a* by rotational force of the electric motor 126*b* being transmitted via a transmission gear mechanism configured from a later-described first transmission gear 128*b* and the second transmission gear 130*b*.

The masking cam drive means 114*a* (114*b*) comprises: the electric motor 126*a* (126*b*) attached directly or indirectly to the other of the frames, namely frame F'; and the transmission gear mechanism for transmitting rotational force of the electric motor 126*a* (126*b*) to the gear portion 122*a* (122*b*) of the masking cam 112*a* (112*b*). The electric motor 126*a* (126*b*) has an encoder built in, and is configured such that rotational phase control of the cam portion 120*a* (120*b*) of the masking cam 112*a* (112*b*) is respectively executed based on a detection value of this encoder. Such rotational phase control may be executed by an appropriately outputted operating signal, for example, a predetermined operating signal outputted from an appropriate signal output means, or by satisfaction of "AND" between this operating signal and a detection signal outputted based on a detection value of a detecting means for detecting rotational phase of the folding cylinder 40. The transmission gear mechanism comprises: the first transmission gear 128*a* (128*b*) connected to an output shaft of the electric motor 126*a* (126*b*); and the second transmission gear 130*a* (130*b*) that meshes with both of the first transmission gear 128*a* (128*b*) and the gear portion 122*a* (122*b*) of the masking cam 112*a* (112*b*). The second transmission gear 130*a* (130*b*) is attached via shaft bearings to a shaft 140 provided protruding to an inner side of the device from the other of the frames, namely frame F'. Each of the masking cam drive means 114*a* and 114*b* is configured capable of independently causing the corresponding masking cams 112*a* and 112*b* to be angularly displaced around the axial center of the folding cylinder main body 40*a*.

The thrust blade mechanisms 43*a* and 43*b* are configured capable of changing a position in a circumferential direction in the folding device main body 40*a* based on the length in the conveying direction (cutoff) of the individual sheets FP. Specifically, assuming a position during maximum cutoff to be a reference position of the thrust blade mechanism 43*a* (43*b*), the thrust blade mechanism 43*a* (43*b*) is configured capable of being rotationally displaced by a maximum of 35° from the reference position, centered on the axial center of the folding cylinder main body 40*a*. A direction of rotational displacement is an identical direction to the rotating direction Y of the folding cylinder main body 40*a* (that is, a direction that reduces a distance to the paper edge holding mechanism 41*a* (41*b*) on a forward side in the rotating direction) when cutoff is shortened, and is a reverse direction to the rotating direction Y of the folding cylinder main body 40*a* (that is, a direction that increases a distance to the paper edge holding mechanism 41*a* (41*b*) on a forward side in the rotating direction) when cutoff is lengthened. Note that a configuration for changing the phase manually may be adopted as a changing means, or a configuration for changing the phase automatically by installing a control device may be adopted as a changing means.

The thrust blade mechanisms 43*a* and 43*b* comprising the above kind of configurations enable the position in the circumferential direction in the folding cylinder main body 40*a* of each of the thrust blade mechanisms 43*a* and 43*b* to be appropriately changed based on cutoff of the individual sheets FP. This makes it possible for a center in the conveying direction of the individual sheets FP to be thrust out accurately, thereby enabling a high precision signature to be produced.

In addition, the thrust blade mechanisms 43*a* and 43*b* comprising the above kind of configurations enable a position in a circumferential direction of the protruding portion of the cam portion 120*a* (120*b*) of the masking cam 112*a* (112*b*) to be aligned with a position in a circumferential direction of the advancing region (blade projecting region) of the endless cam surface of the drive cam 116 to disable the advancing region (blade projecting region), by the masking cam 112*a* (112*b*) being angularly displaced around the axial center of the folding cylinder main body 40*a* by the masking cam drive means 114*a* (114*b*). As a result, a thrusting-out operation of the individual sheets FP by the thrust blade mechanisms 43*a* and 43*b* can be prevented from being executed until an arbitrary timing, thereby enabling a collect run of an arbitrary number of two or more stacked sheets to be executed.

The jaw cylinder 50 is configured including two jaw mechanisms 51*a* and 51*b* installed capable of movement along a circumferential surface of the jaw cylinder 50. The jaw cylinder 50 is installed on a downstream side of the folding cylinder 40 and is configured having a rotating shaft (not illustrated) parallel to the rotating shaft 44 of the folding cylinder 40. Moreover, a rotating direction of the jaw cylinder 50 is configured to be the reverse of that of the folding cylinder 40.

A circumferential speed of the jaw cylinder 50 is configured to synchronize with and have the same speed as that of the folding cylinder 40. Moreover, a circumferential length of the jaw cylinder 50 is configured to have the same circumferential length as a circumferential length of the folding cylinder main body 40*a*.

The jaw cylinder 50 is configured capable of having a phase of the jaw mechanisms 51*a* and 51*b* rotationally displaced based on the phase change of the thrust blade mechanisms 43*a* and 43*b*. A direction of rotational displacement is an identical direction to the rotating direction Z of the jaw cylinder 50 when cutoff is shortened, and is a reverse direction to the rotating direction Z of the jaw cylinder 50 when cutoff is lengthened.

The jaw mechanisms 51*a* and 51*b* are configured including a jaw cam (not illustrated), a cam follower of the jaw cam (not illustrated), and a jaw blade (not illustrated). In the present embodiment, the jaw mechanisms 51*a* and 51*b* are installed with equal spacing in two places at an outer circumference of the jaw cylinder 50. This jaw mechanism 51*a* (51*b*) is disposed such that when the folding cylinder 40 and the jaw cylinder 50 rotate and the thrust blade mechanism 43*a* (43*b*) installed in the folding cylinder 40 operates, the thrust blade 106*a* (106*b*) can be received. That is, the thrust blade mechanism 43*a* (43*b*) and the jaw mechanism 51*a* (51*b*) are disposed such that when the folding cylinder 40 and the jaw cylinder 50 are rotating, the thrust blade mechanism 43*a* (43*b*) and the jaw mechanism 51*a* (51*b*) oppose each other at a position where the folding cylinder 40 and the jaw cylinder 50 come closest to each other.

That concludes description of the example of configuration of the printer and the variable cutoff folding device 1 according to the present embodiment. As mentioned above, the printer according to the present embodiment cuts a printing-completed continuous paper W by a cutting mechanism 10, conveys individual sheets FP rendered in sheet form to a downward-of-folding conveyor mechanism 30 by a speed-increasing conveyor mechanism 20, further conveys the individual sheets FP to a folding cylinder 40 by the downward-of-folding conveyor mechanism 30, executes a straight run or a collect run of an arbitrary number of stacked sheets by the folding cylinder 40, and, every approximately half rotation of the folding cylinder 40 or every arbitrary plurality of rotations of the folding cylinder 40, grips a single individual sheet FP or a sheet group configured from an arbitrary number of stacked sheets by a jaw cylinder 50, thereby producing a signature. Specifically, in the printer of the present embodiment, a cutting spacing of the cutting mechanism 10, a conveying speed of the downward-of-folding conveyor mechanism 30, and a circumferential speed of the folding cylinder 40 and the jaw cylinder 50 are configured to be appropriately set or adjusted based on a length in a conveying direction of the individual sheets FP. Moreover, in the variable cutoff folding device 1 of the present embodiment, paper edge holding mechanisms 41*a* and 41*b* are configured capable of holding a leading edge in the conveying direction of the individual sheets FP and capable of changing a timing of releasing holding of the individual sheets FP, and thrust blade mechanisms 43*a* and 43*b* are configured capable of projecting the individual sheets FP to an outer side in a radial direction and capable of changing a position in a circumferential direction in the folding cylinder 40 based on the length in the conveying direction of the individual sheets FP.

Next, operation of the printer and the variable cutoff folding device 1 according to the present embodiment is described. Note that specifically the description below proceeds divided into the cases of during maximum cutoff and during minimum cutoff.

First of all, operation performed by the printer and the variable cutoff folding device 1 in a state set during maximum cutoff is described. That is, the speed-increasing conveyor mechanism 20 conveys the individual sheets FP cut by the cutting mechanism 10 slightly more quickly.

First, an operator using the printer and the variable cutoff folding device 1 sets cutoff of the individual sheets FP to 813 mm. As mentioned above, in the present embodiment, the circumferential length of the cutting mechanism 10 is configured to be a length equal to maximum cutoff, hence setting the supply speed of the supplied continuous paper W and the circumferential speed of the cutter cylinder 11 to be equal results in cutoff of the individual sheets FP being constant at 813 mm.

In addition, the operator adjusts a position in the circumferential direction of the releasing region (pin retracting region) B of the drive cam 58 of the paper edge holding mechanisms 41*a* and 41*b* and adjusts a position in the circumferential direction in the folding cylinder 40 of the thrust blade mechanisms 43*a* and 43*b*, based on cutoff (813 mm) of the individual sheets FP, such that the timing of releasing holding of the individual sheets FP by the paper edge holding mechanisms 41*a* and 41*b* and a position in the conveying direction of the individual sheets FP at which the individual sheets FP are projected out by the thrust blade mechanisms 43*a* and 43*b* are an optimal timing and position. Specifically, the position in the circumferential direction in the folding cylinder 40 of the blade thrust mechanisms 43*a* and 43*b* is adjusted to a position in the circumferential direction that results in the thrust blades 106*a* and 106*b* being positioned in a central portion in the conveying direction of the individual sheets FP. Moreover, the position in the circumferential direction of the releasing region (pin retracting region) B of the drive cam 58 of the paper edge holding mechanisms 41*a* and 41*b* is adjusted to a position in the circumferential direction that results in the drive cam-dedicated cam follower 54*a* (54*b*) retracting into (moving along) the releasing region (pin retracting region) B of the drive cam 58 when the thrust blade mechanism 43*a* (43*b*) operates to execute projecting out of the individual sheets FP by the thrust blade 106*a* (106*b*) (refer to FIGS. 8B and 9A).

Figure 6:
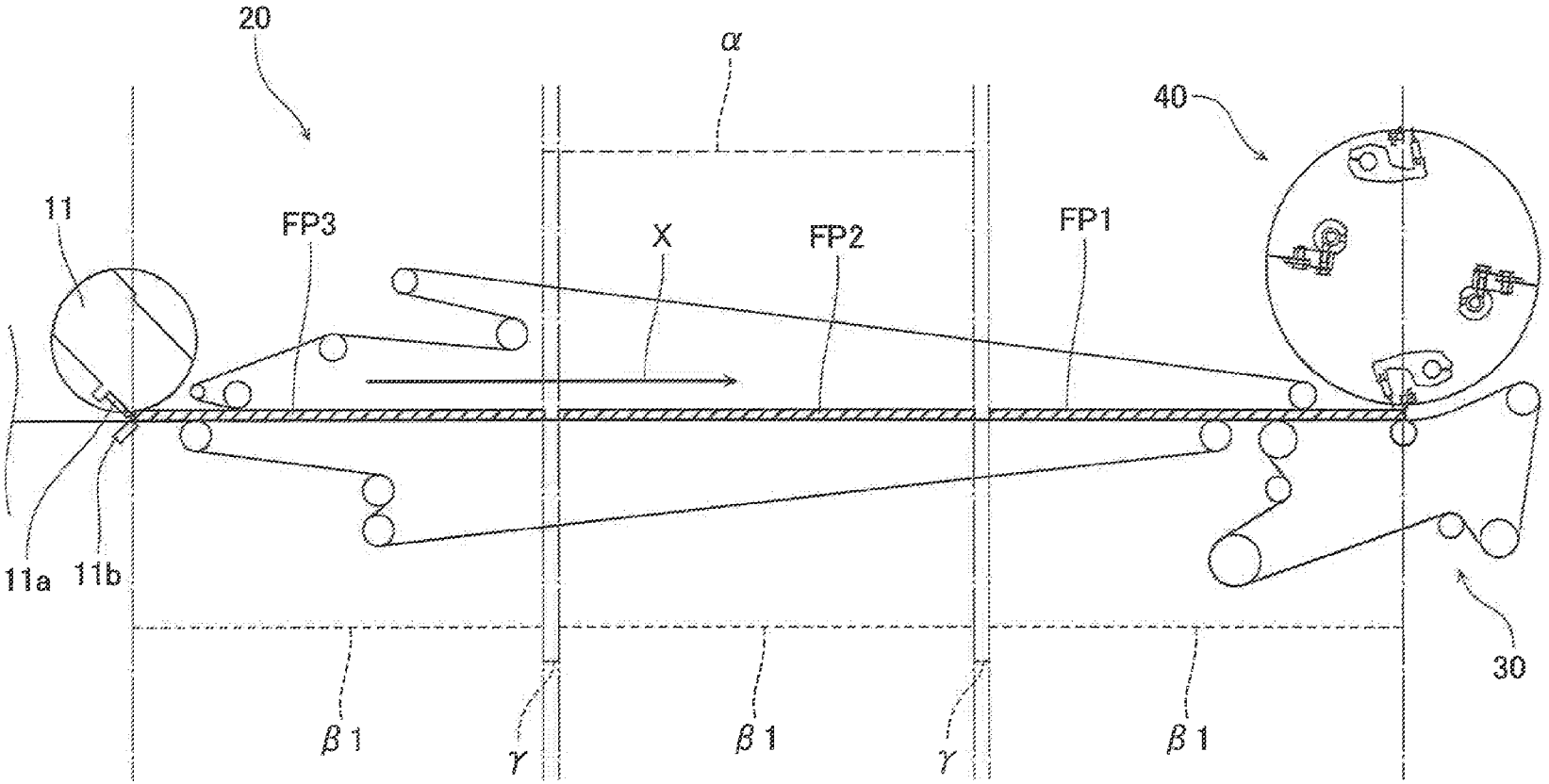
FIG. 6 is a view showing schematically an example where a speed-increasing conveyor mechanism conveys individual sheets cut with maximum cutoff.

FIG. 6 is a view showing an example where the speed-increasing conveyor mechanism 20 conveys individual sheets FP cut with maximum cutoff. In FIG. 6, the dashed line α indicates "a length of a half circumference of the folding cylinder", the dashed line β1 indicates "a length of the individual sheets FP cut with maximum cutoff", and the dashed line γ indicates "a spacing caused by action of the speed-increasing conveyor mechanism 20". Note that since a position of the individual sheet FP3 is a position of the individual sheet FP3 at exactly the time when cut by the cutting cylinder 11, the individual sheet FP3 is not subject to action of the speed-increasing conveyor mechanism 20.

As shown in FIG. 6, the speed-increasing conveyor mechanism 20 conveys the individual sheets FP1, FP2, FP3, . . . , FPN of cutoff 813 mm to the downward-of-folding conveyor mechanism 30. At this time, the individual sheets FP are conveyed at a post-cutting conveying speed which is faster than a pre-cutting conveying speed (in other words, accelerated after cutting), hence the speed-increasing conveyor mechanism 20 creates a spacing between adjacent individual sheets FP, and this spacing corresponds to a difference in the pre-cutting conveying speed and post-cutting conveying speed. However, during maximum cutoff, the difference in speed is small, hence the spacing created by the speed-increasing conveyor mechanism 20 is negligible.

Figure 8A:
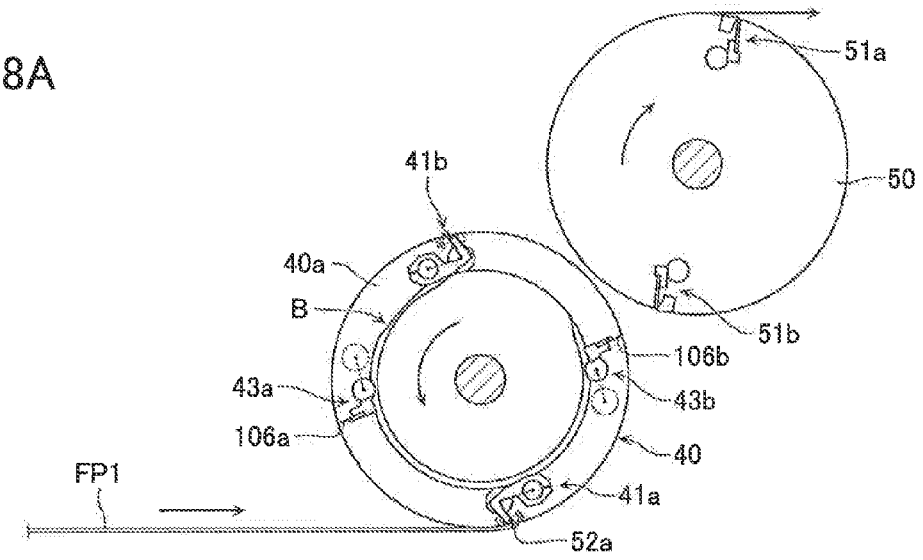
FIG. 8A is a view showing schematically a state where an individual sheet cut with maximum cutoff is held by the paper edge holding mechanism.

When the speed-increasing conveyor mechanism 20 conveys the leading individual sheet FP1 to the downward-of-folding conveyor mechanism 30, the downward-of-folding conveyor mechanism 30 butts the individual sheet FP1 against the stopper 42 of the folding cylinder 40 at the same speed as the circumferential speed of the folding cylinder 40 (refer to FIGS. 5 and 8A).

Simultaneous to the individual sheet FP1 being butted against the stopper 42, the paper holding pin 52*a* (52*b*) of the paper edge holding mechanism 41*a* (41*b*) of the folding cylinder 40 stabs the front edge portion in the conveying direction of the individual sheet FP1, whereby the folding cylinder 40 collects the individual sheet FP1. When the folding cylinder 40 makes a half rotation (rotates to a next butting position of the stopper 42) in a state where the individual sheet FP1 is held, the individual sheet FP2 conveyed via the speed-increasing conveyor mechanism 20 and the downward-of-folding conveyor mechanism 30 is butted against the stopper 42 and stabbed by the paper holding pin 52*b* (52*a*) of the paper edge holding mechanism 41*b* (41*a*), similarly to the individual sheet FP1.

Figure 7:
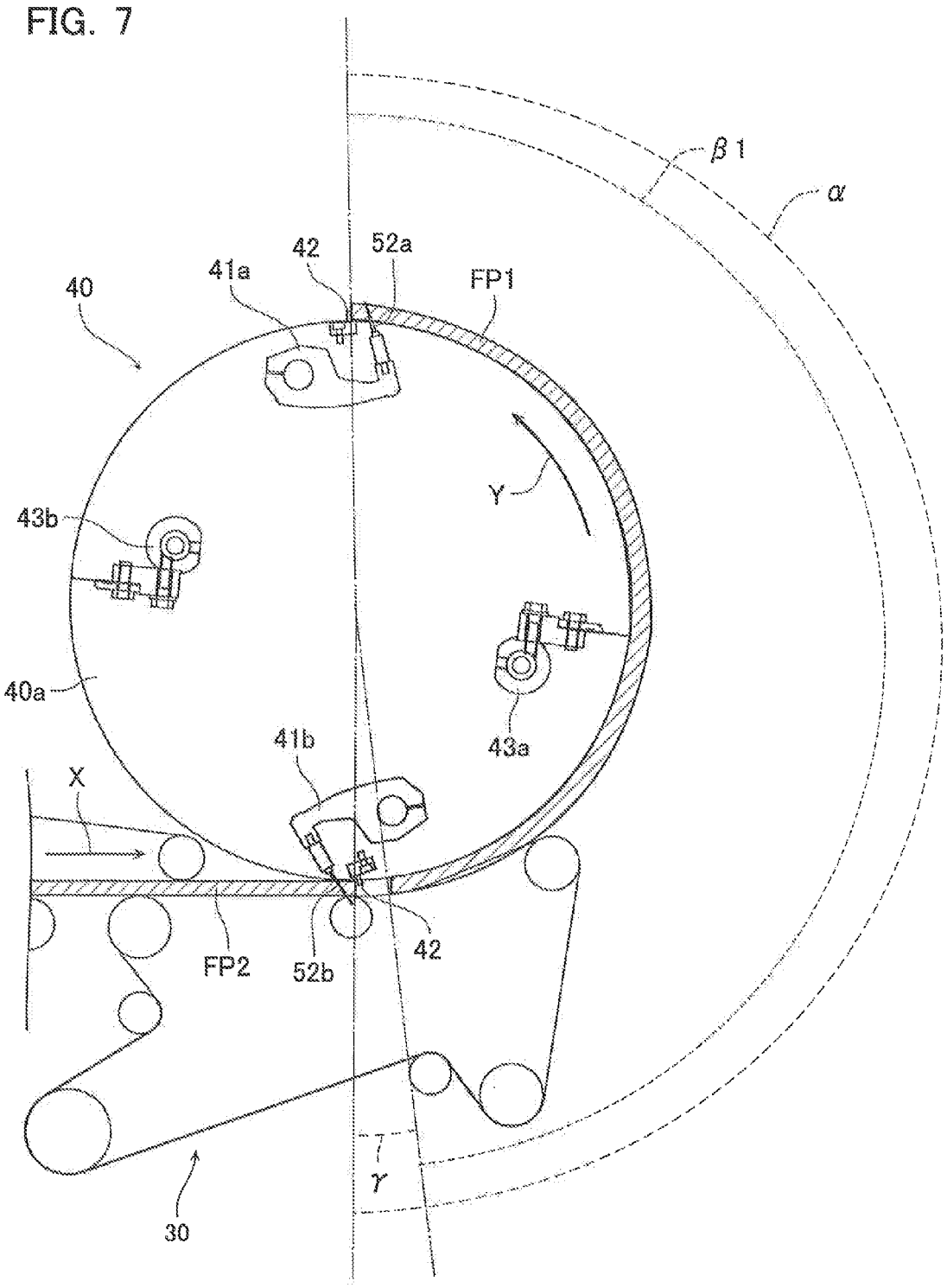
FIG. 7 is a view showing schematically an example where the folding cylinder collects a following individual sheet by wrapping the following individual sheet around the folding cylinder, during maximum cutoff.

FIG. 7 is a view showing an example where the folding cylinder 40 collects the following individual sheet FP2 during maximum cutoff. As shown in FIG. 7, a combined length of "maximum cutoff" indicated by the dashed line β1 and "a spacing caused by action of the speed-increasing conveyor mechanism 20" indicated by the dashed line γ is equal to "a length of a half circumference of the folding cylinder 40" indicated by the dashed line α. Therefore, the individual sheets FP of maximum cutoff collected by the folding cylinder 40 are necessarily held by the paper edge holding mechanism 41*a* (41*b*) in a state where a leading edge in the running direction is butted against the stopper 42, thereby enabling a cyclical collect operation in the folding cylinder 40 to be accurately performed. In other words, it becomes possible to produce a high quality signature.

Figure 8B:
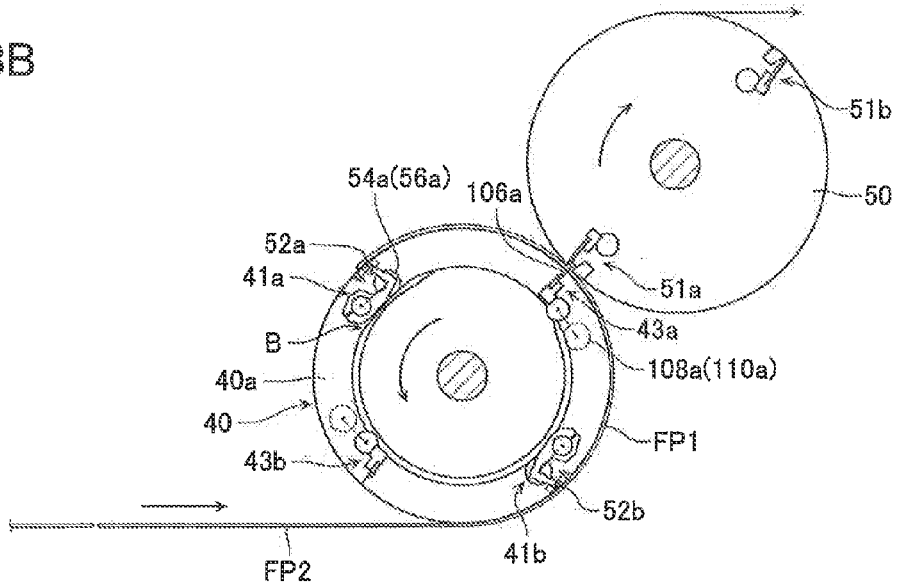
FIG. 8B is a view showing schematically a state where holding of the individual sheet due to the paper edge holding mechanism is released.

Then, as shown in FIG. 8B, the folding cylinder 40 further rotates in a state where the leading individual sheet FP1 is held by the paper edge holding mechanism 41*a* and the following individual sheet FP2 is held by the paper edge holding mechanism 41*b*, and, when a distance between the thrust blade 106*a* of the thrust blade mechanism 43*a* and the jaw mechanism 51*a* of the jaw cylinder 50 becomes minimum, an operation projecting out the individual sheet FP1 by the thrust blade mechanism 43*a* is executed. Moreover, simultaneous to this, the drive cam-dedicated cam follower 54*a* of the paper edge holding mechanism 41*a* enters the releasing region B, whereby the tip of the paper holding pin 52*a* retreats further to an inner side in the radial direction of the folding cylinder main body 40*a* than the circumferential surface of the folding cylinder main body 40*a*, thereby releasing the held individual sheet FP1.

Figure 8C:
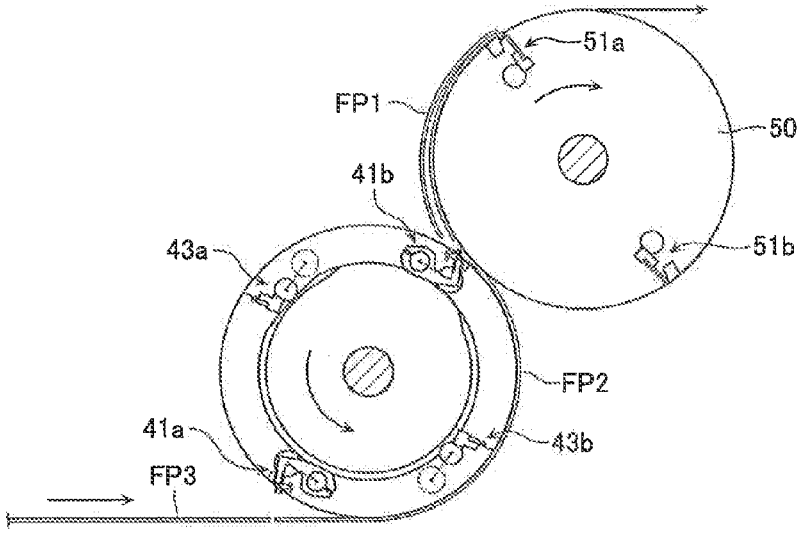
FIG. 8C is a view showing schematically a state where the individual sheet is transferred to a jaw cylinder.

As shown in FIG. 8C, the individual sheet FP1 projected out by the thrust blade mechanism 43*a* is gripped in a half fold state by the jaw mechanism 51*a* of the jaw cylinder 50, and, after being formed into a signature, is conveyed toward an accumulating mechanism (post-processing device) or the like, not illustrated, which is disposed on a downstream side.

Note that FIGS. 8A~8C illustrate an aspect of a so-called straight run where a signature is formed by a single individual sheet FP1, but the variable cutoff folding device 1 according to the present embodiment is not limited to this aspect and is also capable of executing a collect run configured from an arbitrary number of stacked sheets. Such a collect run can be realized by disabling the releasing region B of the drive cam 58 of the paper edge holding mechanisms 41*a* and 41*b* and disabling the advancing region of the drive cam 116 of the thrust blade mechanisms 43*a* and 43*b* until the individual sheets FP reach the arbitrary number of stacked sheets, and then, when the individual sheets FP have reached the arbitrary number of stacked sheets, activating the releasing region B of the drive cam 58 of the paper edge holding mechanisms 41*a* and 41*b* and activating the advancing region of the drive cam 116 of the thrust blade mechanisms 43*a* and 43*b*. For example, explaining specifically using the example of the paper edge holding mechanism 41*a* (41*b*), the masking cam 62*a* (62*b*) is angularly displaced by about 70° in a forward direction around the axial center of the folding cylinder main body 40*a* by the masking cam drive means 64*a* (64*b*), from a position in the circumferential direction of the masking cam 62*a* (62*b*) where a position in the circumferential direction of the protruding portion 88 does not overlap the releasing region B of the drive cam 58 (reference position, that is, position where a masking cam attachment reference line 62*c* is directed straight up) shown in FIG. 9A, to a position in the circumferential direction of the masking cam 62*a* (62*b*) where a position in the circumferential direction of the protruding portion 88 completely overlaps the releasing region B of the drive cam 58 (releasing region disabling position, that is, position where a masking cam attachment reference line 62*d* is directed straight up) shown in FIG. 9B. This results in the releasing region B of the drive cam 58 of the paper edge holding mechanisms 41*a* and 41*b* being disabled. On the other hand, when the collect run is continued and the individual sheets FP have become a sheet group configured from the arbitrary number of stacked sheets, the masking cam 62*a* (62*b*) is angularly displaced by about 70° in a reverse direction around the axial center of the folding cylinder main body 40*a*. This results in the releasing region B of the drive cam 58 being activated. Control of the masking cams 112*a* and 112*b* of the thrust blade mechanisms 43*a* and 43*b* is executed similarly to that of the masking cams 62*a* and 62*b* of the paper edge holding mechanisms 41*a* and 41*b*. This enables the collect run for configuring a sheet group of an arbitrary number of stacked sheets to be executed.

That concludes description of operation of the variable cutoff folding device 1 during maximum cutoff. Next, operation of the variable cutoff folding device 1 during minimum cutoff is described. A problem when changing cutoff is that the circumferential length of the folding cylinder 40 cannot be changed. That is, cutoff of the individual sheets FP becoming shorter means a length in the running direction becoming shorter, which in turn means an arrival spacing of the individual sheets FP also inevitably becoming shorter. Therefore, a head edge position of the individual sheets FP conveyed to the folding cylinder 40 arrives faster than the folding cylinder makes a half rotation, whereby it becomes impossible to stab a leading edge side in the running direction of the individual sheets FP at an appropriate pin stabbing position. Accordingly, in the printer according to the present embodiment, it is decided to overcome this problem by utilizing a difference in conveying speed due to the speed-increasing conveyor mechanism 20.

First, the cutter cylinder 11 raises a circumferential speed based on a change to minimum cutoff. Specifically, in view of a length ratio between maximum cutoff (813 mm) and minimum cutoff (546 mm), the cutter cylinder 11 changes to 1.5 times the circumferential speed. That is, cutoff is set to minimum cutoff by performing cutting at 1.5 times the speed.

In addition, a position in the circumferential direction of the releasing region B of the drive cam 58 of the paper edge holding mechanisms 41*a* and 41*b* is adjusted and a position in the circumferential direction in the folding cylinder 40 of the thrust blade mechanisms 43*a* and 43*b* is adjusted, based on the change to minimum cutoff (546 mm), such that the timing of releasing holding of the individual sheets FP by the paper edge holding mechanisms 41*a* and 41*b* and a position in the conveying direction of the individual sheets FP at which the individual sheets FP are projected out by the thrust blade mechanisms 43*a* and 43*b* are an optimal timing and position. Specifically, the thrust blade mechanisms 43*a* and 43*b* are moved in an identical direction to the rotating direction Y of the folding cylinder main body 40*a* (that is, a direction that reduces a distance to the paper edge holding mechanism 41*a* (41*b*) on a forward side in the rotating direction), such that the thrust blades 106*a* and 106*b* are positioned in the central portion in the conveying direction of the individual sheets FP. Moreover, the drive cam 58 of the paper edge holding mechanisms 41*a* and 41*b* is angularly displaced by, for example, 29.5° in the opposite direction to the rotating direction Y of the folding cylinder main body 40*a*, such that the drive cam-dedicated cam follower 54*a* (54*b*) retracts into (moves along) the releasing region (pin retracting region) B of the drive cam 58 when the thrust blade mechanism 43*a* (43*b*) operates to execute projecting out of the individual sheets FP by the thrust blade 106*a* (106*b*) (refer to FIGS. 12B and 13A). Angularly displacing the drive cam 58 of the paper edge holding mechanisms 41*a* and 41*b* in the opposite direction to the rotating direction Y of the folding cylinder main body 40*a* in this way enables timing at which the drive cam-dedicated cam follower 54*a* (54*b*) enters the releasing region B of the drive cam 58 and timing at which holding of the individual sheets FP by the paper edge holding mechanisms 41*a* and 41*b* is released to be made earlier than during maximum cutoff.

Figure 10:
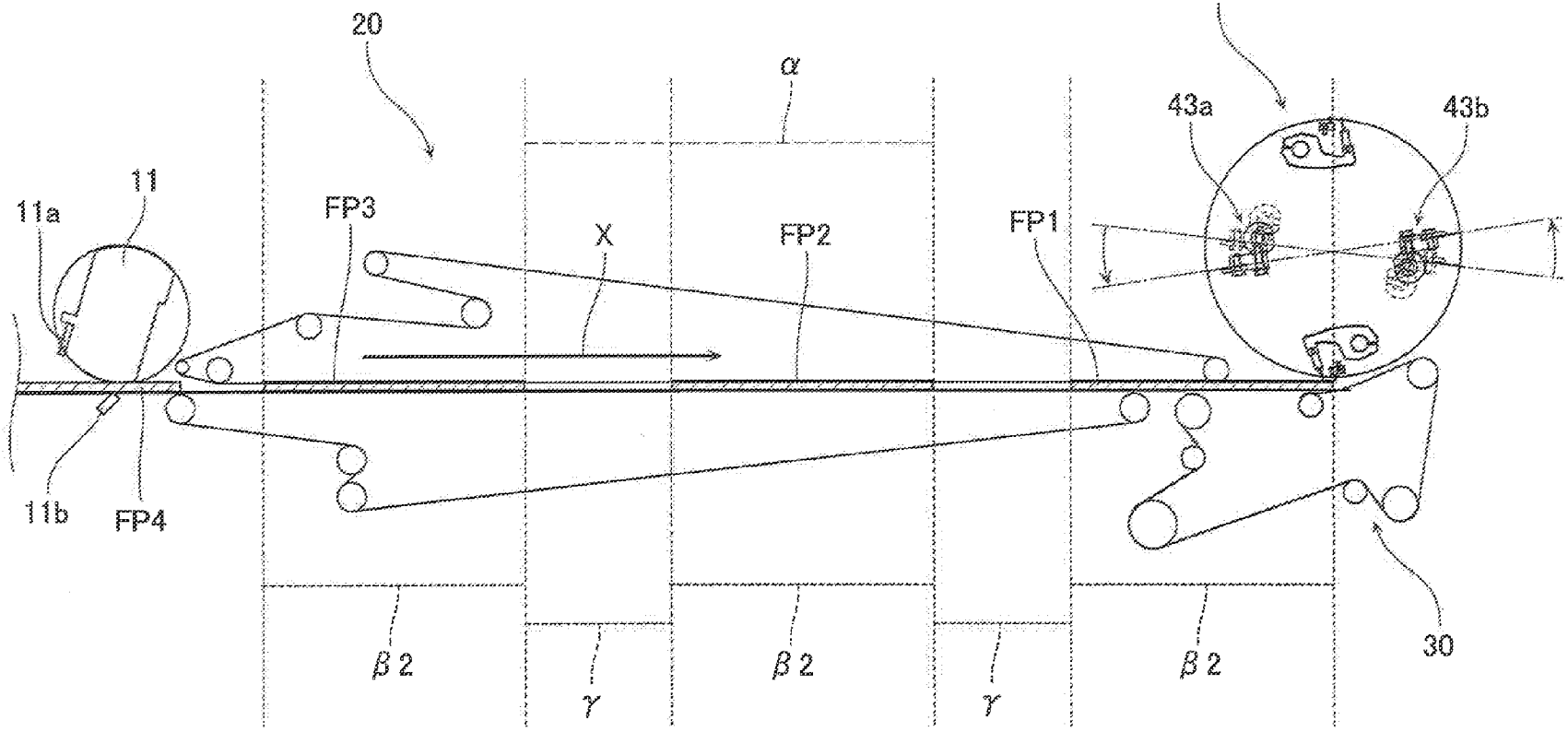
FIG. 10 is a view showing schematically an example where the speed-increasing conveyor mechanism conveys individual sheets cut with minimum cutoff.

Now, FIG. 10 is a view showing an example where the speed-increasing conveyor mechanism 20 conveys individual sheets FP cut with minimum cutoff. In FIG. 10, the dashed line α indicates "a length of a half circumference of the folding cylinder", the dashed line β indicates "a length of the individual sheets FP cut with minimum cutoff", and the dashed line γ indicates "a spacing caused by action of the speed-increasing conveyor mechanism 20".

As shown in FIG. 10, the speed-increasing conveyor mechanism 20 conveys the individual sheets FP1, FP2, FP3, FP4, . . . , FPN of cutoff 546 mm to the downward-of-folding conveyor mechanism 30. As mentioned above, the speed-increasing conveyor mechanism 20 during minimum cutoff changes to 1.5 times the conveying speed during maximum cutoff. That is, as shown in FIG. 10, the individual sheets FP1, FP2, FP3, and FP4 become shorter and the spacing between the individual sheets FP becomes larger, compared to during maximum cutoff.

Figure 11:
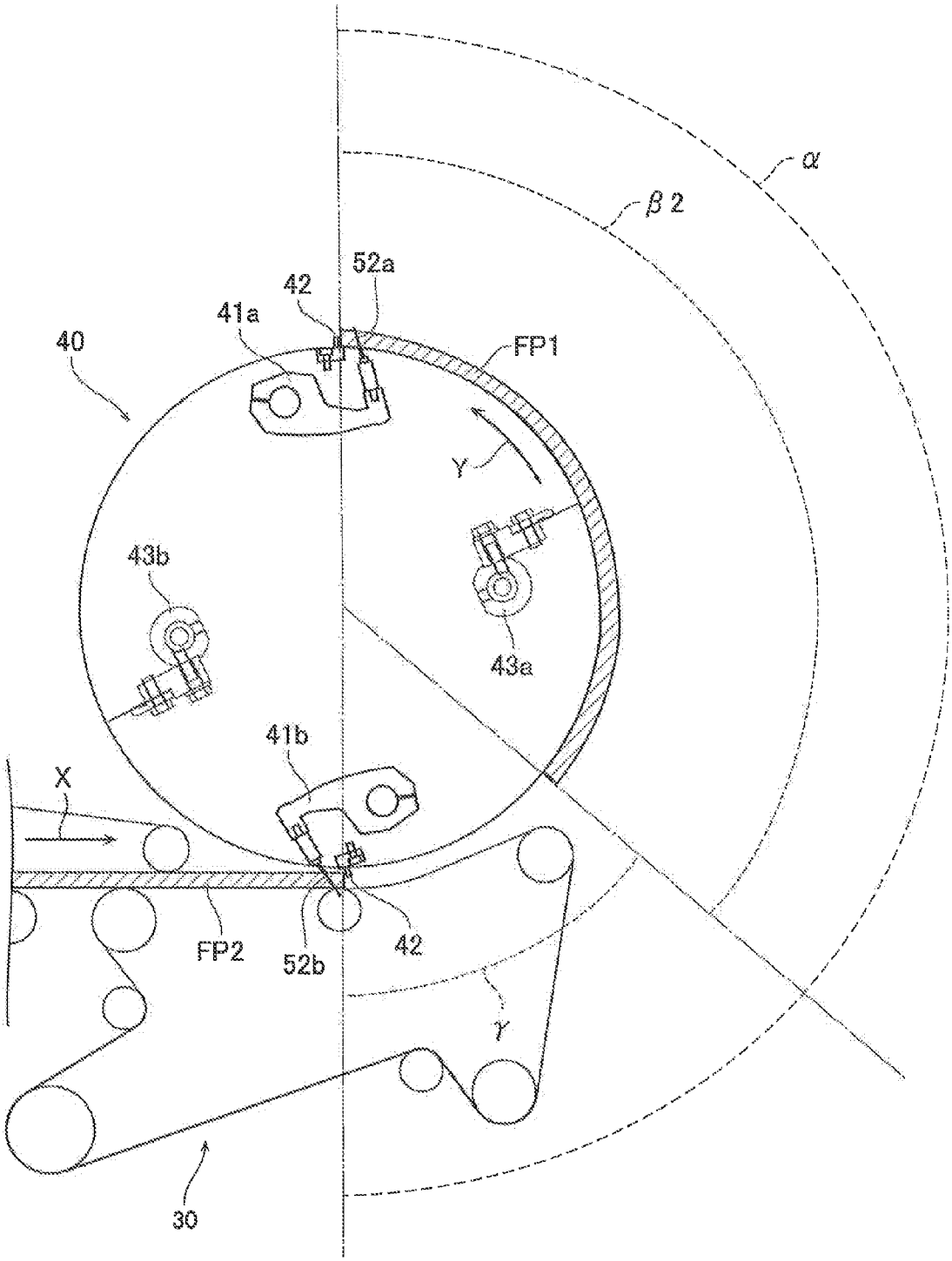
FIG. 11 is a view showing schematically an example where the folding cylinder collects a following individual sheet by wrapping the following individual sheet around the folding cylinder, during minimum cutoff.
Figure 12A:
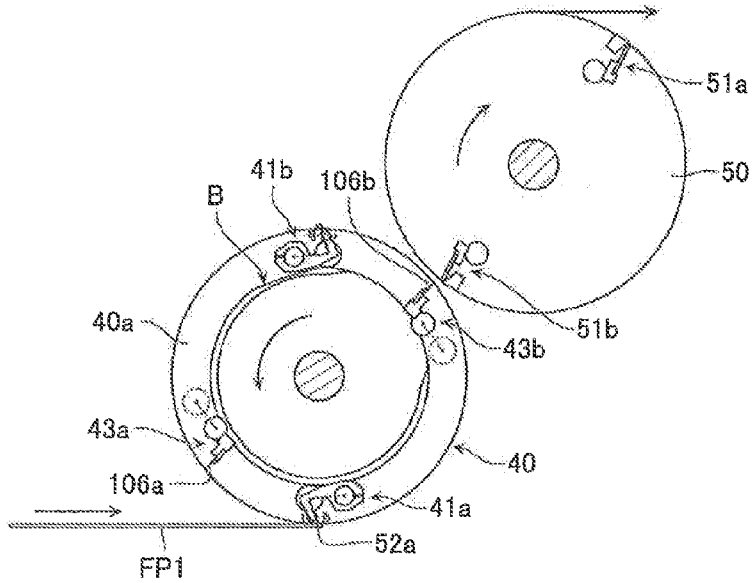
FIG. 12A is a view showing schematically a state where an individual sheet cut with minimum cutoff is held by the paper edge holding mechanism.

When the speed-increasing conveyor mechanism 20 conveys the leading individual sheet FP1 to the downward-of-folding conveyor mechanism 30, the downward-of-folding conveyor mechanism 30 butts the individual sheet FP1 against the stopper 42 of the folding cylinder 40 at the same speed as the circumferential speed of the folding cylinder 40 (refer to FIGS. 11 and 12A).

Simultaneous to the individual sheet FP1 being butted against the stopper 42, the paper holding pin 52*a* (52*b*) of the paper edge holding mechanism 41*a* (41*b*) of the folding cylinder 40 stabs the front edge portion in the conveying direction of the individual sheet FP1, whereby the folding cylinder 40 collects the individual sheet FP1. When the folding cylinder 40 makes a half rotation (rotates to a next butting position of the stopper 42) in a state where the individual sheet FP1 is held, the individual sheet FP2 conveyed via the speed-increasing conveyor mechanism 20 and the downward-of-folding conveyor mechanism 30 is butted against the stopper 42 and stabbed by the paper holding pin 52*b* (52*a*) of the paper edge holding mechanism 41*b* (41*a*), similarly to the individual sheet FP1.

FIG. 11 is a view showing an example where the folding cylinder 40 collects the following individual sheet FP2 during minimum cutoff. As shown in FIG. 11, a combined length of "minimum cutoff" indicated by the dashed line β2 and "a spacing caused by action of the speed-increasing conveyor mechanism 20" indicated by the dashed line γ is equal to "a length of a half circumference of the folding cylinder 40" indicated by the dashed line α. Therefore, since the variable cutoff folding device 1 according to the present embodiment adopts a configuration that increases the speed of the post-cutting individual sheets FP by the speed-increasing conveyor mechanism 20 to create a spacing corresponding to the difference in speed, a distance between the leading edge in the running direction of the leading individual sheet FP and the leading edge in the running direction of the following individual sheet FP is equal to the length of a half circumference of the folding cylinder 40, thereby making it possible to fix an appropriate head edge position of the individual sheets FP even if a change in cutoff is performed.

Figure 12B:
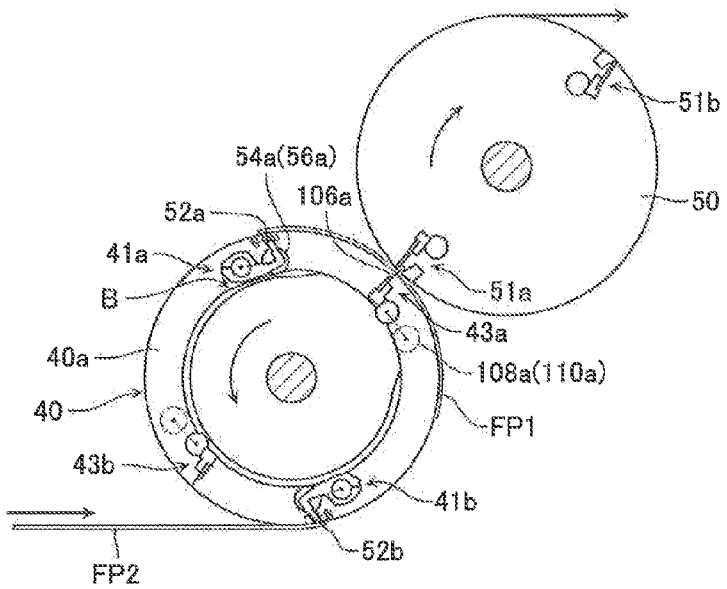
FIG. 12B is a view showing schematically a state where holding of the individual sheet due to the paper edge holding mechanism is released.

Then, as shown in FIG. 12B, the folding cylinder 40 further rotates in a state where the leading individual sheet FP1 is held by the paper edge holding mechanism 41*a* and the following individual sheet FP2 is held by the paper edge holding mechanism 41*b*, and, when a distance between the thrust blade 106*a* of the thrust blade mechanism 43*a* and the jaw mechanism 51*a* of the jaw cylinder 50 becomes minimum, an operation projecting out the individual sheet FP1 by the thrust blade mechanism 43*a* is executed. Moreover, simultaneous to this, the drive cam-dedicated cam follower 54*a* of the paper edge holding mechanism 41*a* enters the releasing region B, whereby the tip of the paper holding pin 52*a* retreats further to an inner side in the radial direction of the folding cylinder main body 40*a* than the circumferential surface of the folding cylinder main body 40*a*, thereby releasing the held individual sheet FP1.

Now, due to the length of the individual sheets FP collected by the folding cylinder 40 becoming shorter, a central position of the individual sheets FP gripped in the jaw mechanisms 51*a* and 51*b* changes. Therefore, as mentioned above, the thrust blade mechanisms 43*a* and 43*b* change a phase based on a change being made from during maximum cutoff to during minimum cutoff. Moreover, if the phase of only the thrust blade mechanisms 43*a* and 43*b* is changed, then a misalignment of synchronization between the thrust blade mechanisms 43*a* and 43*b* and the jaw mechanisms 51*a* and 51*b* occurs, with the result that when the thrust blades 106*a* and 106*b* of the thrust blade mechanisms 43*a* and 43*b* operate, the jaw mechanisms 51*a* and 51*b* are not positioned at a place opposing the thrust blade mechanisms 43*a* and 43*b*. It therefore becomes impossible for gripping of the individual sheet FP1 by the jaw mechanisms 51*a* and 51*b* to be performed. Accordingly, the jaw cylinder 50 configured including the jaw mechanisms 51*a* and 51*b* changes a phase to synchronize with the change in phase of the thrust blade mechanisms 43*a* and 43*b*. It therefore becomes possible for the thrust blades 106*a* and 106*b* of the phase-changed thrust blade mechanisms 43*a* and 43*b* to operate, and for the individual sheet FP1 projected out by the operated thrust blades 106*a* and 106*b* to be gripped by the jaw mechanisms 51*a* and 51*b*.

Figure 12C:
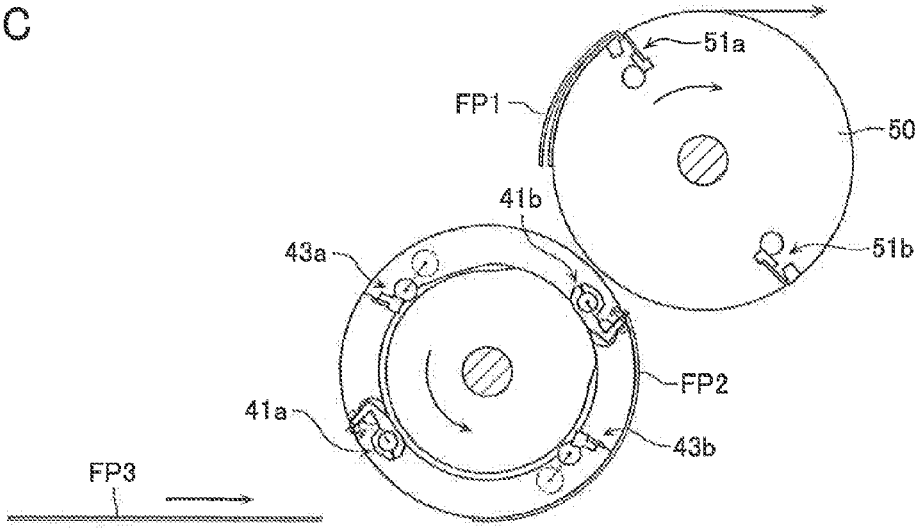
FIG. 12C is a view showing schematically a state where the individual sheet is transferred to the jaw cylinder.

In this way, as shown in FIG. 12C, the individual sheet FP1 projected out by the thrust blade mechanism 43*a* is gripped in a half fold state by the jaw mechanism 51*a* of the jaw cylinder 50, and, after being formed into a signature, is conveyed toward an accumulating mechanism (post-processing device) or the like, not illustrated, which is disposed on a downstream side.

Figure 13A:
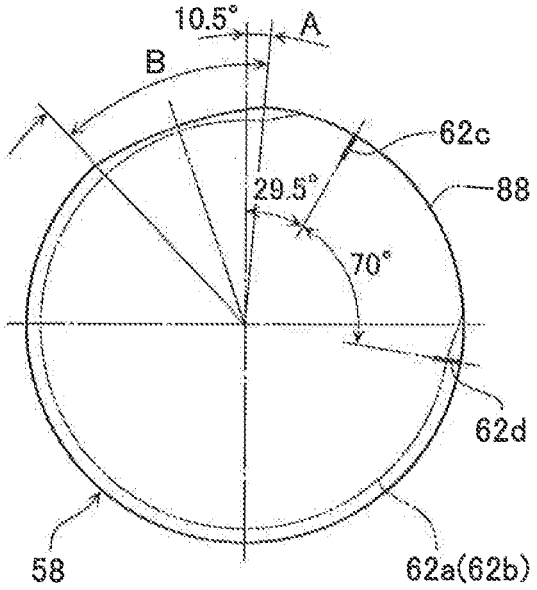
FIG. 13A is a view showing a positional relationship of the drive cam and the masking cam in a state where the releasing region of the drive cam is not masked by the masking cam, during minimum cutoff.
Figure 13B:
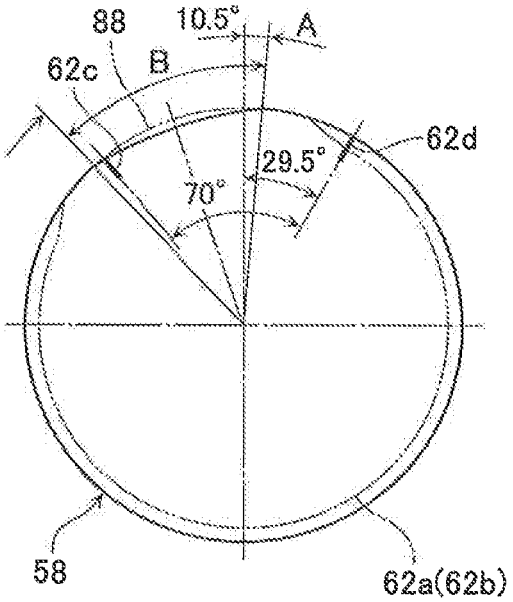
FIG. 13B is a view showing a positional relationship of the drive cam and the masking cam in a state where the releasing region of the drive cam is masked by the masking cam, during minimum cutoff.

Note that FIGS. 12A~12C illustrate an aspect of a so-called straight run where a signature is formed by a single individual sheet FP1, but the variable cutoff folding device 1 according to the present embodiment is not limited to this aspect and is also capable of executing a collect run configured from an arbitrary number of stacked sheets (refer to FIGS. 13A and 13B). In this case, the masking cams 62*a* and 62*b* of the paper edge holding mechanisms 41*a* and 41*b* have the reference position adjusted to be in synchronization with the drive cam 58. This results in an amount of angular displacement of the masking cams 62*a* and 62*b* being about 70°, similarly to the above-described case during maximum cutoff.

That concludes description of operation of the variable cutoff folding device 1 during minimum cutoff.

As mentioned above, due to the paper edge holding mechanisms 41*a* and 41*b* being configured capable of holding a leading edge portion in the conveying direction of the individual sheets FP and capable of changing timing of releasing holding of the individual sheets FP based on the length in the conveying direction of the individual sheets FP, and due to the thrust blade mechanisms 43*a* and 43*b* being configured capable of projecting out the individual sheets FP to an outer side in the radial direction and capable of changing a position in the circumferential direction in the folding cylinder 40 based on the length in the conveying direction of the individual sheets FP, the printer and the variable cutoff folding device 1 according to the present embodiment make it possible for the paper holding pins 52*a* and 52*b* to be withdrawn from the sheet at an appropriate timing based on cutoff and for the thrust blades 106*a* and 106*b* to be projected out at an appropriate half fold position based on cutoff. As a result, the printer and the variable cutoff folding device 1 according to the present embodiment can produce a high quality signature while handling a change in cutoff.

Moreover, due to being configured such that angular displacement of the drive cam 58 and masking cams 62*a* and 62*b* of the paper edge holding mechanisms 41*a* and 41*b* and the masking cams 112*a* and 112*b* of the thrust blade mechanisms 43*a* and 43*b* is executed by an electric motor and a transmission gear mechanism, the printer and the variable cutoff folding device 1 according to the present embodiment make it possible to handle even an amount of angular displacement that is difficult to realize by angular displacement due to a conventional electric motor and link mechanism such as described in Patent Document 2.

Furthermore, the printer according to the present invention is configured to cut a continuous paper W into individual sheets FP having an arbitrary cutting length by means of a cutting mechanism 10 configured capable of changing the cutting length, convey the individual sheets at an increased speed based on a change in the cutting length by means of a speed-increasing conveyor mechanism 20 configured capable of changing a conveying speed, stab paper holding pins 52*a* and 52*b* into a leading edge in a running direction of the individual sheets FP by means of paper edge holding mechanisms 41*a* and 41*b* installed in a folding cylinder 40, thrust blades 106*a* and 106*b* against the individual sheets FP stabbed by the paper edge holding mechanisms 41*a* and 41*b* by means of thrust blade mechanisms 43*a* and 43*b* installed in the folding cylinder 40 and configured capable of displacement based on the change in cutting length, and grip the thrust blades 106*a* and 106*b* by means of jaw mechanisms 51*a* and 51*b* installed in a jaw cylinder 50 configured capable of rotational displacement based on displacement of the thrust blade mechanisms 43*a* and 43*b*, and thereby produce a signature. The printer according to the present embodiment is thus configured capable of producing a high quality signature while handling a change in cutoff. In other words, the printer according to the present embodiment makes it possible to create a sheet spacing corresponding to cutoff by changing the conveying speed based on the speed-increasing conveyor mechanism 20, and hence makes it possible to provide an optimal signature while handling a change in cutoff, in a state that installation space of the entire device is maintained unchanged.

Moreover, the printer according to the present embodiment makes it possible to achieve a timing for wrapping the sheets around the folding cylinder 40 matched to the circumferential length of the folding cylinder 40 without, for example, performing timing adjustment by detecting a positional relationship of the individual sheets FP by an electronic device such as a sensor, and so on, and thus makes it possible to suppress cost of the entire device.

That concludes description of preferred embodiments of the present invention, but the technical scope of the present invention is not limited to the scope described in the above-mentioned embodiments. Various changes or improvements may be added to each of the above-described embodiments.

For example, in the variable cutoff folding device 1 according to the present embodiment, the paper edge holding mechanisms 41*a* and 41*b* and the thrust blade mechanisms 43*a* and 43*b* were each configured comprising a masking cam, a masking cam drive means, and a masking cam-dedicated cam follower, but the present embodiment is not limited to this configuration, and a configuration that does not comprise these masking cam, masking cam drive means, and masking cam-dedicated cam follower may also be adopted. In the case of adopting such a configuration that does not comprise a masking cam, masking cam drive means, and masking cam-dedicated cam follower, the result is a variable cutoff folding device only capable of executing a so-called straight run. In such a variable cutoff folding device only capable of executing a straight run, the paper holding pin 52*a* (52*b*) of the paper edge holding mechanism 41*a* (41*b*) is configured such that when the drive cam-dedicated cam follower 54*a* (54*b*) moves along the holding region A of the endless cam surface of the drive cam 58, the tip of the paper holding pin 52*a* (52*b*) advances further to an outer side in the radial direction of the folding cylinder main body 40*a* than the circumferential surface of the folding cylinder main body 40*a*, and is configured such that when the drive cam-dedicated cam follower 54*a* (54*b*) moves along the releasing region B of the endless cam surface of the drive cam 58, the tip of the paper holding pin 52*a* (52*b*) retreats further to an inner side in the radial direction of the folding cylinder main body 40*a* than the circumferential surface of the folding cylinder main body 40*a*. Moreover, similarly, the thrust blade 106*a* (106*b*) of the thrust blade mechanism 43*a* (43*b*) is configured such that when the drive cam-dedicated cam follower 108*a* (108*b*) moves along the retreating region of the endless cam surface of the drive cam 116, the leading edge of the thrust blade 106*a* (106*b*) retreats further to an inner side in the radial direction of the folding cylinder main body 40*a* than the circumferential surface of the folding cylinder main body 40*a*, and is configured such that when the drive cam-dedicated cam follower 108*a* (108*b*) moves along the advancing region of the endless cam surface of the drive cam 116, the leading edge of the thrust blade 106*a* (106*b*) advances further to an outer side in the radial direction of the folding cylinder main body 40*a* than the circumferential surface of the folding cylinder main body 40*a*.

Moreover, in the variable cutoff folding device according to the present embodiment, a configuration was adopted in which two each of each of the paper edge holding mechanisms 41*a* and 41*b* and the thrust blade mechanisms 43*a* and 43*b* are provided, but the present embodiment is not limited to this configuration, and one of each of these mechanisms or three or more of each of these mechanisms may also be provided. Note that the case where one each of the paper edge holding mechanisms and thrust blade mechanisms are provided results in a circumferential length of the folding cylinder main body becoming half of the circumferential length of the folding cylinder main body 40*a* according to the present embodiment, and, additionally, results in one each of each of the masking cams, masking cam drive means, and masking cam-dedicated cam followers being provided. Moreover, the case where X each of the paper edge holding mechanisms and thrust blade mechanisms (where X is an integer of 3 or more) are provided results in a circumferential length of the folding cylinder main body becoming X/2 times the circumferential length of the folding cylinder main body 40*a* according to the present embodiment, and, additionally, results in X each of each of the masking cams, masking cam drive means, and masking cam-dedicated cam followers being provided.

In addition, in the variable cutoff folding device according to the present embodiment, the masking cam drive means 114*a* and 114*b* of the thrust blade mechanisms 43*a* and 43*b* were described as comprising an electric motor and a transmission gear mechanism, but the present embodiment is not limited to such a configuration. For example, a hydraulic cylinder may be employed in place of the electric motor, and, for example, a link mechanism may be employed in place of the transmission gear mechanism.

Furthermore, in the variable cutoff folding device according to the present embodiment, the stopper 42 allows a head position of the conveyed individual sheets FP to be reliably positioned without being affected by a type of the individual sheets FP or a conveying speed of the individual sheets, and so on, and is thus preferably provided. However, the present embodiment is not limited to such a configuration, and the stopper 42 need not be provided, depending on conditions (for example, rigidity, surface state, conveying speed, and so on, of paper) of the conveyed individual sheets FP.

Moreover, in the printer according to the present embodiment, the suction devices 22, 24, and 32 adopt a configuration where a sheet is suctioned using a vacuum, but the present embodiment is not limited to this configuration. For example, a configuration where a sucker is provided on a belt and the sheet is conveyed by directly suctioning by the sucker may also be employed.

Furthermore, in the printer according to the present embodiment, the cutting mechanism 10 in the above-described embodiment adopts a configuration employing a rotating-type cutter cylinder. However, the present embodiment is not limited to this configuration, and, for example, a piston-type cutter capable of cutting at a constant speed and capable of changing a cutting spacing may also be employed.

Moreover, the above-mentioned embodiments specifically described configurations for handling operation "during maximum cutoff" and operation "during minimum cutoff". However, cutoff is not limited to these two. That is, it is of course also possible to arbitrarily change cutoff in a range between "maximum cutoff" and "minimum cutoff" and produce a signature corresponding to the changed cutoff.

It is clear from descriptions of scope in the patent claims that modified examples of the kind described above are included in the scope of the present invention.

What is claimed is:

1. A variable cutoff folding device, comprising:

a folding cylinder for sequentially receiving an individual sheet conveyed from an upstream side; and a jaw cylinder for receiving the individual sheet from the folding cylinder and carrying the individual sheet to a downstream side, the folding cylinder comprising:

a paper edge holding mechanism configured capable of holding a front edge portion in a conveying direction of the individual sheet and capable of changing a timing for releasing holding of the individual sheet based on a length in the conveying direction of the individual sheet; and a thrust blade mechanism configured capable of thrusting the individual sheet to an outer side in a radial direction of the folding cylinder and capable of changing a position in a circumferential direction in the folding cylinder based on the length in the conveying direction of the individual sheet, wherein the paper edge holding mechanism comprises:

a drive cam that includes an endless cam surface on a circumferential surface thereof and is capable of angular displacement around an axial center of the folding cylinder, the endless cam surface being configured from a holding region and a releasing region, the holding region having a certain radius, and the releasing region having a radius which is smaller than that of the holding region;

a drive cam drive mechanism that includes a drive source and a transmission mechanism, the transmission mechanism being configured to cause the drive cam to undergo angular displacement around the axial center of the folding cylinder by transmitting a rotational force of the drive source to the drive cam;

a drive cam-dedicated cam follower provided to be movable along the endless cam surface of the drive cam; and a paper holding pin that is connected to the drive cam-dedicated cam follower, is configured such that, when the drive cam-dedicated cam follower moves along the holding region of the endless cam surface, a tip of the paper holding pin projects further to the outer side in the radial direction of the folding cylinder than the circumferential surface of the folding cylinder, and is configured such that, when the drive cam-dedicated cam follower moves along the releasing region of the endless cam surface, the tip of the paper holding pin retracts further to an inner side in the radial direction of the folding cylinder than the circumferential surface of the folding cylinder, wherein the thrust blade mechanism comprises:

a drive cam that includes an endless cam surface on a circumferential surface thereof, the endless cam surface of the drive cam of the thrust blade mechanism being configured from a withdrawing region and an advancing region, the withdrawing region having a certain radius, and the advancing region having a radius which is smaller than that of the withdrawing region;

a drive cam-dedicated cam follower provided to be movable along the endless cam surface of the drive cam of the thrust blade mechanism; and a thrust blade that is connected to the drive cam-dedicated cam follower of the thrust blade mechanism, is configured such that, when the drive cam-dedicated cam follower of the thrust blade mechanism moves along the withdrawing region of the endless cam surface, a tip of the thrust blade retracts further to the inner side in the radial direction of the folding cylinder than the circumferential surface of the folding cylinder, and is configured such that, when the drive cam-dedicated cam follower moves along the advancing region of the endless cam surface, the tip of the thrust blade projects further to the outer side in the radial direction of the folding cylinder than the circumferential surface of the folding cylinder, wherein the drive cam of the thrust blade mechanism is provided in a state of being incapable of rotation with respect to a frame of the variable cutoff folding device, wherein the drive cam-dedicated cam follower and the thrust blade of the thrust blade mechanism are configured capable of changing positions in a circumferential direction in the folding cylinder based on the length in the conveying direction of the individual sheet, and wherein the drive cam of the paper edge holding mechanism is configured capable of angular displacement around the axial center of the folding cylinder with respect to the drive cam of the thrust blade mechanism by the drive cam drive mechanism.

2. The variable cutoff folding device according to claim 1, wherein the drive cam of the paper edge holding mechanism includes a cam portion, a gear portion, and a connecting portion, the cam portion including on a circumferential surface thereof the endless cam surface of the drive cam of the paper edge holding mechanism, the gear portion having formed on a circumferential surface thereof a gear tooth, and the connecting portion being for connecting the cam portion and the gear portion, the drive source of the drive cam drive mechanism of the paper edge holding mechanism is an electric motor, and the transmission mechanism is a transmission gear mechanism that transmits the rotational force of the electric motor to the gear portion of the drive cam.

3. The variable cutoff folding device according to claim 1, wherein the paper edge holding mechanism further comprises:

a masking cam having a protruding portion formed protruding toward an outer side in a radial direction of the masking cam, the protruding portion having a radius which is substantially identical to that of the holding region of the endless cam surface of the drive cam of the paper edge holding mechanism and having a length in a circumferential direction which is not less than a length in a circumferential direction of the releasing region of the endless cam surface of the drive cam of the paper edge holding mechanism, a circumferential surface of the protruding portion forming a mask cam surface of the masking cam;

a masking cam drive mechanism that includes a drive source and a transmission mechanism, the transmission mechanism of the masking cam drive mechanism being configured to cause the masking cam to undergo angular displacement around the axial center of the folding cylinder by transmitting a rotational force of the drive source of the masking cam drive mechanism to the masking cam; and a masking cam-dedicated cam follower connected to the paper holding pin and provided to be movable over the mask cam surface of the masking cam, and the paper holding pin is configured such that, when at least one of the drive cam-dedicated cam follower and the masking cam-dedicated cam follower moves along the holding region of the endless cam surface of the drive cam of the paper edge holding mechanism or the mask cam surface of the masking cam, the tip of the paper holding pin projects further to the outer side in the radial direction of the folding cylinder than the circumferential surface of the folding cylinder.

4. The variable cutoff folding device according to claim 3, wherein the masking cam includes a cam portion, a gear portion, and a connecting portion, the cam portion including the protruding portion, the gear portion having formed on a circumferential surface thereof a gear tooth, and the connecting portion being for connecting the cam portion and the gear portion, the drive source of the masking cam drive mechanism is an electric motor, and the transmission mechanism is a transmission gear mechanism that transmits the rotational force of the electric motor to the gear portion of the masking cam.

5. A printer comprising the variable cutoff folding device recited in claim 1.

* * * * *